US011710438B2

(12) United States Patent
Xi et al.

(10) Patent No.: US 11,710,438 B2
(45) Date of Patent: Jul. 25, 2023

(54) DISPLAY DATA PROCESSING METHOD OF DISPLAY DEVICE FOR DETERMINING GRAY-SCALE VALUE USING NOISE REDUCTION FUNCTION, DISPLAY DEVICE, ELECTRONIC DEVICE, AND STORAGE MEDIUM

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yanhui Xi, Beijing (CN); Tiankuo Shi, Beijing (CN); Yan Sun, Beijing (CN); Xiaomang Zhang, Beijing (CN); Yifan Hou, Beijing (CN); Xin Duan, Beijing (CN); Wei Sun, Beijing (CN); Ming Chen, Beijing (CN); Yifang Chu, Beijing (CN); Lingyun Shi, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 56 days.

(21) Appl. No.: 17/428,846

(22) PCT Filed: Mar. 27, 2020

(86) PCT No.: PCT/CN2020/081734
§ 371 (c)(1),
(2) Date: Aug. 5, 2021

(87) PCT Pub. No.: WO2021/189437
PCT Pub. Date: Sep. 30, 2021

(65) Prior Publication Data

US 2022/0309984 A1 Sep. 29, 2022

(51) Int. Cl.
*G09G 3/20* (2006.01)
*G09G 3/36* (2006.01)

(52) U.S. Cl.
CPC ..... *G09G 3/2007* (2013.01); *G09G 3/3611* (2013.01); *G09G 2320/0626* (2013.01)

(58) Field of Classification Search
None
See application file for complete search history.

(56) References Cited

U.S. PATENT DOCUMENTS

2017/0358255 A1* 12/2017 Wang ..... G09G 3/2055

* cited by examiner

*Primary Examiner* — Chad M Dicke

(57) ABSTRACT

A display data processing method of a display device, a display device, an electronic device, and a storage medium are disclosed. The display data processing method includes: in response to a frequency of the dimming screen being consistent with a frequency of the display screen: determining a first gray-scale value of the first dimming pixel according to a plurality of input gray-scale values in an input image; determining a second gray-scale value of the first dimming pixel according to the first gray-scale value and a noise reduction function, where the noise reduction function is a monotonically increasing function in an interval (0, 1); obtaining a dimming gray-scale value of the first dimming pixel based on the second gray-scale value; and determining a plurality of target gray-scale values corresponding to the plurality of first display pixels according to the plurality of input gray-scale values and the dimming gray-scale value.

20 Claims, 10 Drawing Sheets

| | | |
|---|---|---|
| 500 | 408 | 483 |
| 309 | 102 | 500 |
| 755 | 906 | 238 |

| | | |
|---|---|---|
| 500 | 408 | 483 |
| 309 | 202 | 500 |
| 755 | 906 | 238 |

DISPLAY DATA PROCESSING METHOD OF DISPLAY DEVICE FOR DETERMINING GRAY-SCALE VALUE USING NOISE REDUCTION FUNCTION, DISPLAY DEVICE, ELECTRONIC DEVICE, AND STORAGE MEDIUM

TECHNICAL FIELD

The embodiments of the present disclosure relate to a display data processing method of a display device, a display device, an electronic device, and a storage medium.

BACKGROUND

A liquid crystal display panel can include two liquid crystal display screens which overlap with each other, one of the two liquid crystal display screens is used for displaying images, and the other of the two liquid crystal display screens is used for local dimming. This kind of liquid crystal display panel can significantly improve its contrast, and the display effect of the liquid crystal display panel is comparable to the display effect of an organic light-emitting diode (OLED) display panel. The liquid crystal display panel including two liquid crystal display screens can be called a double-cell liquid crystal display panel, which can achieve high-precision dynamic dimming with a contrast of more than 100,000 levels and millions of levels of partitions through double-screen control, and is highly favored by customers.

SUMMARY

At least one embodiment of the present disclosure provides a display data processing method of a display device. The display device comprises a dimming screen and a display screen, the dimming screen is on a backlight side of the display screen and is configured to perform backlight modulation on the display screen, the dimming screen comprises a plurality of dimming pixels, the plurality of dimming pixels comprise a first dimming pixel, the display screen comprises a plurality of display pixels, the plurality of display pixels comprise a plurality of first display pixels, and the first dimming pixel is configured to provide backlight modulation for the plurality of first display pixels. The display data processing method comprises: in response to a case where a frequency of the dimming screen is consistent with a frequency of the display screen: determining a first gray-scale value of the first dimming pixel according to a plurality of input gray-scale values, which are in one-to-one correspondence with the plurality of first display pixels, in an input image; determining a second gray-scale value of the first dimming pixel according to the first gray-scale value of the first dimming pixel and a noise reduction function, the noise reduction function being a monotonically increasing function in an interval (0, 1), and having an intersection point P(x0, y0) with a function y=x in a case where x is in the interval (0, 1), and in a case where x is in an interval (0, x0), a function value of the noise reduction function being less than a function value y of the function y=x; obtaining a dimming gray-scale value of the first dimming pixel based on the second gray-scale value of the first dimming pixel; and determining a plurality of target gray-scale values corresponding to the plurality of first display pixels according to the plurality of input gray-scale values and the dimming gray-scale value of the first dimming pixel.

For example, in the display data processing method provided by at least one embodiment of the present disclosure, the noise reduction function comprises:

$$y_{sub2}=1/(1+e^{\wedge}(A-y_{sub1}*B))$$

where A and B are noise reduction parameters and constants, $y_{sub1}$ represents the first gray-scale value of the first dimming pixel, and $y_{sub2}$ is the function value of the noise reduction function and represents the second gray-scale value of the first dimming pixel.

For example, in the display data processing method provided by at least one embodiment of the present disclosure, A=4 and B=14.

For example, in the display data processing method provided by at least one embodiment of the present disclosure, the plurality of dimming pixels are arranged in an array of Q rows and P columns, and the first dimming pixel is arranged in an a-th row and b-th column in the array formed by the plurality of dimming pixels, Q, P, a, and b are positive integers, and $1 \le a \le Q$, $1 \le b \le P$; determining the first gray-scale value of the first dimming pixel according to the plurality of input gray-scale values, which are in one-to-one correspondence with the plurality of first display pixels, in the input image, comprises: determining a display pixel group corresponding to the first dimming pixel among the plurality of display pixels, the display pixel group comprising the plurality of first display pixels, each of the plurality of first display pixels comprising a plurality of first sub-display pixels, and each of the plurality of input gray-scale values comprising a plurality of sub-input gray-scale values, and the plurality of sub-input gray-scale values being in one-to-one correspondence with the plurality of first sub-display pixels; determining an input pixel gray-scale value corresponding to each of the plurality of first display pixels according to the plurality of sub-input gray-scale values of an input gray-scale value corresponding to each of the plurality of first display pixels, to obtain a plurality of input pixel gray-scale values corresponding to the plurality of first display pixels; and determining the first gray-scale value of the first dimming pixel according to the plurality of input pixel gray-scale values corresponding to the plurality of first display pixels.

For example, in the display data processing method provided by at least one embodiment of the present disclosure, the plurality of first display pixels are arranged in an array of nt rows and mt columns, where nt is a positive integer and mt is a positive integer; the determining the first gray-scale value of the first dimming pixel according to the plurality of input pixel gray-scale values corresponding to the plurality of first display pixels, comprises: according to the plurality of input pixel gray-scale values corresponding to the plurality of first display pixels, calculating nt row sampling values of the nt rows corresponding to the plurality of first display pixels by a first group of calculation formulas; for a row sampling value of an n-th row in the nt rows, the first group of calculation formulas comprising:

$$S1(n)=(NA*\max(n)>(2^M-1))?(2^M-1):NA*\max(n);$$

$$S2(n)=(NE*\mathrm{mean}(n)>(2^M-1))?(2^M-1):NE*\mathrm{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and VL(n) is the row sampling value of the n-th row; determining the first gray-scale value of the first dimming pixel as the maximum value of the nt row sampling values corresponding to the plurality of first display pixels.

For example, in the display data processing method provided by at least one embodiment of the present disclosure, the determining the first gray-scale value of the first dimming pixel according to the plurality of input pixel gray-scale values corresponding to the plurality of first display pixels, comprises: determining the first gray-scale value of the first dimming pixel as a maximum value of the plurality of input pixel gray-scale values.

For example, in the display data processing method provided by at least one embodiment of the present disclosure, the obtaining the dimming gray-scale value of the first dimming pixel based on the second gray-scale value of the first dimming pixel, comprises: processing the second gray-scale value of the first dimming pixel, to obtain the dimming gray-scale value of the first dimming pixel.

For example, in the display data processing method provided by at least one embodiment of the present disclosure, the processing the second gray-scale value of the first dimming pixel, comprises: performing a smooth filtering operation or a bright line detection operation on the second gray-scale value of the first dimming pixel.

For example, in the display data processing method provided by at least one embodiment of the present disclosure, the plurality of first display pixels are arranged in an array of nt rows and mt columns, nt is a positive integer and mt is a positive integer; and the determining the first gray-scale value of the first dimming pixel according to the plurality of input pixel gray-scale values corresponding to the plurality of first display pixels, comprises: according to the plurality of input pixel gray-scale values corresponding to the plurality of first display pixels, calculating nt row sampling values of the nt rows corresponding to the plurality of first display pixels by a first group of calculation formulas, for a row sampling value of an n-th row in the nt rows, the first group of calculation formulas comprising:

$$S1(n)=(NA*\max(n)>(2^M-1))?(2^M-1):NA*\max(n);$$

$$S2(n)=(NE*\mathrm{mean}(n)>(2^M-1))?(2^M-1):NE*\mathrm{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and the row sampling value of the n-th row takes high M-bit of VL(n); calculating nt row correction values of the nt rows by a second calculation formula, for a row correction value of the n-th row, the second calculation formula comprising:

$$VLX(n)=KX(n)*(KA*S1(n)+(1-KA)*S2(n)),$$

where KX(n)=0.5 or 0.25, and the row correction value of the n-th row takes high M-bit data of VLX(n); according to the nt row sampling values and the nt row correction values, calculating nt row final values of the nt rows by a third calculation formula, for a row final value of the n-th row, the third calculation formula comprising:

$$VLF(n)=(VL(n)<<M)+VLX(n);$$

where VLF(n) represents the row final value of the n-th row; taking maximum high M-bit data among nt high M-bit data in the nt row final values and maximum low M-bit data among nt low M-bit data in the nt row final values, to obtain the first gray-scale value of the first dimming pixel, a length of the first gray-scale value of the first dimming pixel being 2*M bits.

For example, in the display data processing method provided by at least one embodiment of the present disclosure, the determining the second gray-scale value of the first dimming pixel according to the first gray-scale value and the noise reduction function, comprises: taking high M-bit data of the first gray-scale value of the first dimming pixel, and calculating high M-bit data of the second gray-scale value of the first dimming pixel by the noise reduction function; and taking low M-bit data of the first gray-scale value of the first dimming pixel, and calculating low M-bit data of the second gray-scale value of the first dimming pixel by the noise reduction function, a length of the second gray-scale value of the first dimming pixel being 2*M bits.

For example, in the display data processing method provided by at least one embodiment of the present disclosure, the plurality of dimming pixels further comprise a second dimming pixel, and the second dimming pixel is in a (a+1)-th row and b-th column in the array formed by the plurality of dimming pixels, and obtaining the dimming gray-scale value of the first dimming pixel based on the second gray-scale value of the first dimming pixel, comprises: performing a data preparation operation on the second gray-scale value of the first dimming pixel, to obtain an intermediate value of the first dimming pixel. The data preparation operation comprises: taking the high M-bit data of the second gray-scale value of the first dimming pixel as first data, and taking the low M-bit data of the second gray-scale value of the second dimming pixel as second data; a length of the first data and a length of the second data are both M bits; obtaining a weight value of the first dimming pixel by a fourth calculation formula, the fourth calculation formula comprising:

$$Q=KS*LD+(1-KS)*HD;$$

where HD is the first data, LD is the second data, KS=0.5, and Q is the weight value of the first dimming pixel; obtaining the intermediate value of the first dimming pixel by a fifth calculation formula, the fifth calculation formula comprising:

$$T=KQ*Q+(1-KQ)*Z;$$

where Z is a maximum value between the first data and the second data, and KQ=0.5, and the intermediate value of the first dimming pixel is high M-bit data of T; and obtaining the dimming gray-scale value of the first dimming pixel based on the intermediate value of the first dimming pixel.

For example, in the display data processing method provided by at least one embodiment of the present disclosure, M=8, 10 or 12.

For example, in the display data processing method provided by at least one embodiment of the present disclosure, the determining the display pixel group corresponding to the first dimming pixel among the plurality of display pixels, comprises: acquiring alignment fitting data used for recording an alignment situation between the dimming screen and the display screen, obtaining an actual corresponding relationship between the plurality of display pixels and the plurality of dimming pixels from a theoretical corresponding relationship between the plurality of display pixels and the plurality of dimming pixels according to the alignment fitting data, and determining the display pixel group corresponding to the first dimming pixel among the plurality of display pixels according to the actual corresponding relationship.

For example, the display data processing method provided by at least one embodiment of the present disclosure further comprises: in response to a case where the frequency of the dimming screen is inconsistent with the frequency of the display screen: acquiring a plurality of frame input images; according to a frequency relationship between the dimming screen and the display screen, determining MD frame display images, corresponding to an x-th frame dimming image of the dimming screen, of the display screen, the MD frame display images corresponding to MD frame input images among the plurality of frame input images, and the x-th frame dimming image corresponding to an i-th frame input image among the MD frame input images, 1<=i<=MD, x being a positive integer greater than 1, and MD being a positive integer greater than 1; according to a plurality of input gray-scale values corresponding to the i-th frame input image, determining an x-th feature value corresponding to the x-th frame dimming image; according to the x-th feature value, determining an x-th set value corresponding to the x-th frame dimming image; and in a case where the x-th frame dimming image is displayed on the dimming screen, taking the x-th set value as the dimming gray-scale value of the first dimming pixel.

For example, the display data processing method provided by at least one embodiment of the present disclosure further comprises: presetting a first set value corresponding to a first frame dimming image, and taking the first set value as the dimming gray-scale value of the first dimming pixel in a case where the first frame dimming image is displayed on the dimming screen.

For example, in the display data processing method provided by at least one embodiment of the present disclosure, each input gray-scale value of the plurality of input gray-scale values corresponding to the i-th frame input image comprises a plurality of sub-input gray-scale values, and an input pixel gray-scale value corresponding to each input gray-scale value is determined according to the plurality of sub-input gray-scale values; and according to the plurality of input gray-scale values corresponding to the i-th frame input image, determining the x-th feature value corresponding to the x-th frame dimming image, comprises: according to all input pixel gray-scale values corresponding to all input gray-scale values of the i-th frame input image, determining the x-th feature value corresponding to the x-th frame dimming image. The x-th feature value is:

$$Ld(x)=k1*\max(x)+1(2*\mathrm{mean}(x),$$

where 0<k1<1, k2=(1−k1)*N, and 1<N<5, max(x) is a maximum value among the all input pixel gray-scale values corresponding to the all input gray-scale values of the i-th frame input image; mean(x) is an average value of the all input pixel gray-scale values corresponding to the all input gray-scale values of the i-th frame input image, Ld(x) represents the x-th feature value.

For example, the display data processing method provided by at least one embodiment of the present disclosure further comprises: acquiring a (x+1)-th set value corresponding to an (x+1)-th frame dimming image of the dimming screen. The acquiring the (x+1)-th set value corresponding to the (x+1)-th frame dimming image of the dimming screen, comprises: acquiring the x-th feature value and the x-th set value; according to the x-th feature value and the x-th set value, determining the (x+1)-th set value corresponding to the (x+1)-th frame dimming image, the (x+1)-th set value is:

$$L(x+1)=k3*L(x)+k4*Ld(x),$$

where L(x+1) is the (x+1)-th set value, L(x) is the x-th set value, Ld(x) is the x-th feature value, and k3=k4=0.5.

For example, in the display data processing method provided by at least one embodiment of the present disclosure, the determining the plurality of target gray-scale values corresponding to the plurality of first display pixels according to the plurality of input gray-scale values and the dimming gray-scale value of the first dimming pixel, comprises: according to an actual corresponding relationship between the plurality of dimming pixels and the plurality of display pixels, determining a dimming pixel group corresponding to each of the plurality of first display pixels in the plurality of dimming pixels, the dimming pixel group comprising MS dimming pixels, and the MS dimming pixels comprising the first dimming pixels; performing a summation operation on dimming gray-scale values of the MS dimming pixels, to determine a plurality of equivalent gray-scale values corresponding to the plurality of first display pixels; determining a plurality of compensation coefficients corresponding to the plurality of first display pixels according to the plurality of input gray-scale values of the input image and the plurality of equivalent gray-scale values corresponding to the plurality of first display pixels; and determining the plurality of target gray-scale values corresponding to the plurality of first display pixels according to the plurality of input gray-scale values of the input image and the plurality of compensation coefficients corresponding to the plurality of first display pixels.

For example, in the display data processing method provided by at least one embodiment of the present disclosure, the performing the summation operation on the dimming gray-scale values of the MS dimming pixels, to determine the plurality of equivalent gray-scale values corresponding to the plurality of first display pixels, comprises: with respect to a W-th first display pixel among the plurality of first display pixels, calculating MS area overlap ratios of the W-th first display pixel and the MS dimming pixels, respectively, W being a positive integer and being less than or equal to an amount of the plurality of first display pixels; performing the summation operation on the dimming gray-scale values of the MS dimming pixels according to the MS area overlap ratios; and determining an equivalent gray-scale value corresponding to the W-th first display pixel, so as to obtain the plurality of equivalent gray-scale values corresponding to the plurality of first display pixels.

For example, in the display data processing method provided by at least one embodiment of the present disclosure, the MS dimming pixels further comprise a third dimming pixel, and the equivalent gray-scale value corresponding to the W-th first display pixel is:

$$y_{eq}(W)=C1*y_{sub3}(B1)+C2*y_{sub3}(B2),$$

where W represents the W-th first display pixel, B1 represents the first dimming pixel, B2 represents the third dimming pixel, C1 represents an area overlap ratio between the first dimming pixel and the W-th first display pixel, C2 represents an area overlap ratio between the third dimming pixel and the W-th first display pixel, $y_{sub3}(B1)$ represents the dimming gray-scale value of the first dimming pixel, $y_{sub3}(B2)$ represents a dimming gray-scale value of the third dimming pixel, and $y_{eq}(W)$ represents the equivalent gray-scale value corresponding to the W-th first display pixel.

For example, in the display data processing method provided by at least one embodiment of the present disclosure, each input gray-scale value of the plurality of input gray-scale values comprises a plurality of sub-input gray-scale values; determining the plurality of compensation coefficients corresponding to the plurality of first display pixels according to the plurality of input gray-scale values of the input image and the plurality of equivalent gray-scale values corresponding to the plurality of first display pixels, comprises: determining input gray-scale values, corresponding to the plurality of first display pixels, of the input image, and determining input pixel gray-scale values corresponding to the plurality of first display pixels according to a plurality of sub-input gray-scale values of the input gray-scale values corresponding to the plurality of first display pixels; calculating the plurality of compensation coefficients corresponding to the plurality of first display pixels by a sixth formula according to the input pixel gray-scale values corresponding to the plurality of first display pixels and the plurality of equivalent gray-scale values corresponding to the first display pixels. The sixth formula comprises:

$$y_c(W)^{\gamma 2}=y_{in}(W)^{\gamma 0}\cdot 1/y_{eq}(W)^{\gamma 1},$$

where $y_c(W)$ is a compensation coefficient corresponding to a W-th first display pixel among the plurality of first display pixels, $y_{in}(W)$ is an input pixel gray-scale value corresponding to the W-th first display pixel, $y_{eq}(W)$ is an equivalent gray-scale value corresponding to the W-th first display pixel, W is a positive integer and is less than or equal to an amount of the plurality of first display pixels, and $\gamma 1=1$, $\gamma 2=\gamma 0=2.2$.

For example, in the display data processing method provided by at least one embodiment of the present disclosure, determining the plurality of target gray-scale values corresponding to the plurality of first display pixels according to the plurality of input gray-scale values of the input image and the plurality of compensation coefficients corresponding to the plurality of first display pixels comprises: determining input gray-scale values, corresponding to the plurality of first display pixels, of the input image; determining the plurality of target gray-scale values corresponding to the plurality of first display pixels according to the input gray-scale values corresponding to the plurality of first display pixels and the plurality of compensation coefficients corresponding to the plurality of first display pixels.

For example, in the display data processing method provided by at least one embodiment of the present disclosure, the plurality of first display pixels comprise a W-th first display pixel, the W-th first display pixel comprises a first sub-display pixel, a second sub-display pixel, and a third sub-display pixel, W is a positive integer and is less than or equal to an amount of the plurality of first display pixels, a target gray-scale value corresponding to the W-th first display pixel comprises a first sub-target gray-scale value corresponding to the first sub-display pixel, a second sub-target gray-scale value corresponding to the second sub-display pixel, and a third sub-target gray-scale value corresponding to the third sub-display pixel, an input gray-scale value corresponding to the W-th first display pixel comprises a first sub-input gray-scale value corresponding to the first sub-display pixel, a second sub-input gray-scale value corresponding to the second sub-display pixel, and a third sub-input gray-scale value corresponding to the third sub-display pixel, and an input pixel gray-scale value corresponding to the W-th first display pixel is determined according to the first sub-input gray-scale value, the second sub-input gray-scale value, and the third sub-input gray-scale value, determining the plurality of target gray-scale values corresponding to the plurality of first display pixels according to the input gray-scale values corresponding to the plurality of first display pixels and the plurality of compensation coefficients corresponding to the plurality of first display pixels, comprises: calculating the plurality of target gray-scale values corresponding to the plurality of first display pixels by a seventh group of formulas. For the W-th first display pixel, the seventh group of formulas is:

$$y_{out}(RW)=y_c(W)*(1/(y_{in}(W)))*\text{Input}(RW)$$

$$y_{out}(GW)=y_c(W)*(1/(y_{in}(W)))*\text{Input}(GW)$$

$$y_{out}(BW)=y_c(W)*(1/(y_{in}(W)))*\text{Input}(BW)$$

where $y_{out}(RW)$, $y_{out}(GW)$, and $y_{out}(BW)$ are the first sub-target gray-scale value, the second sub-target gray-scale value, and the third sub-target gray-scale value corresponding to the W-th first display pixel, respectively, and Input(RW), Input(GW), and Input(BW) respectively represent the first sub-input gray-scale value, the second sub-input gray-scale value, and the third sub-input gray-scale value corresponding to the W-th first display pixel, $y_{in}(W)$ is the input pixel gray-scale value corresponding to the W-th first display pixel, and $y_c(W)$ is a compensation coefficient corresponding to the W-th first display pixel.

At least one embodiment of the present disclosure also provides a display device. The display device comprises: a dimming screen and a display screen, the dimming screen being on a backlight side of the display screen and being configured to perform backlight modulation on the display screen, the dimming screen comprising a plurality of dimming pixels, the plurality of dimming pixels comprising a first dimming pixel, the display screen comprising a plurality of display pixels, the plurality of display pixels comprising a plurality of first display pixels, and the first dimming pixel being configured to provide backlight modulation for the plurality of first display pixels; a preprocessing circuit, configured to determine a display pixel group corresponding to the first dimming pixel among the plurality of display pixels according to a corresponding relationship between the plurality of display pixels and the plurality of dimming pixels; a dimming screen processing circuit comprising: a first operation circuit, configured to determine a first gray-scale value of the first dimming pixel according to a plurality of input gray-scale values, which are in one-to-one correspondence with the plurality of first display pixels, in an input image; a second operation circuit, configured to determine a second gray-scale value of the first dimming pixel according to the first gray-scale value of the first dimming pixel and a noise reduction function, where the noise reduction function is a monotonically increasing function in an interval (0, 1), and has an intersection point P(x0, y0) with a function y=x in a case where x is in the interval (0, 1), and in a case where x is in an interval (0, x0), a function value of the noise reduction function is less than a function value y of the function y=x; a third operation circuit, configured to obtain a dimming gray-scale value of the first dimming pixel based on the second gray-scale value of the first dimming pixel; and a dimming circuit, configured to drive the dimming screen to display according to the dimming gray-scale value of the first dimming pixel; and a display screen processing circuit, comprising: a data compensation circuit, configured to determine a plurality of target gray-scale values corresponding to the plurality of first display pixels according to the plurality of input gray-scale values and the dimming gray-scale value of the first dimming pixel; and a display circuit, configured to drive the display screen to display according to the plurality of target gray-scale values corresponding to the plurality of first display pixels.

At least one embodiment of the present disclosure further provides an electronic device, including: a processor and a memory storing one or more computer programs. The one or more computer programs are configured to be executed by the processor to execute instructions of the display data processing method according to any one of the above embodiments.

At least one embodiment of the present disclosure further provides a storage medium, storing computer readable instructions in a non-transitory manner, in a case where the non-transitory computer readable instructions are executed by a computer, the display data processing method according to any one of the above embodiments is executed.

BRIEF DESCRIPTION OF THE DRAWINGS

In order to clearly illustrate the technical solutions of the embodiments of the present disclosure, the drawings of the embodiments will be briefly described in the following; it is obvious that the described drawings are only related to some embodiments of the present disclosure and thus are not limitative to the present disclosure.

DETAILED DESCRIPTION

Figure 1:
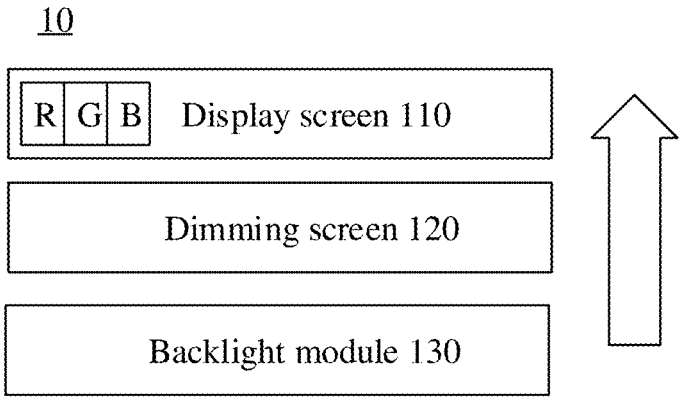
FIG. 1 is a structural schematic diagram of a display device provided by an embodiment of the present disclosure.

In order to make objects, technical solutions, and advantages of the embodiments of the present disclosure apparent, the technical solutions of the embodiments of the present disclosure will be described in a clearly and fully understandable way in connection with the drawings related to the embodiments of the present disclosure. Apparently, the described embodiments are just a part but not all of the embodiments of the present disclosure. Based on the described embodiments of the present disclosure, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to represent any sequence, amount, or importance, but distinguish various components. Also, the terms such as "a," "an," "the" etc., are not intended to limit the amount, but indicate the existence of at least one. Similarly, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to represent relative position relationship, and when the absolute position of the object which is described is changed, the relative position relationship may be changed accordingly.

In a dual-screen high-precision dimming technology, in a low gray-scale part of an input image, the noise, which has a small gray-scale value difference, will be amplified to the extent that it will be detected by human eyes, and this phenomenon is called dark-field noise. Because, in the dual-screen high-precision dimming technology, gray-scale values of a dimming screen are different in different gray-scale parts of the input image, due to a light leakage phenomenon of a liquid crystal, even if gray-scale values of a display screen are the same, there will still be a large display brightness difference due to the different gray-scale values of the dimming screen, especially in low gray-scale regions where human eyes are more sensitive.

At least one embodiment of the present disclosure provides a display data processing method of a display device. The display device comprises a dimming screen and a display screen, the dimming screen is on a backlight side of the display screen and is configured to perform backlight modulation on the display screen, the dimming screen comprises a plurality of dimming pixels, the plurality of dimming pixels comprise a first dimming pixel, the display screen comprises a plurality of display pixels, the plurality of display pixels comprise a plurality of first display pixels, and the first dimming pixel is arranged to provide backlight modulation for the plurality of first display pixels. The display data processing method comprises: in response to a case where a frequency of the dimming screen is consistent with a frequency of the display screen: determining a first gray-scale value of the first dimming pixel according to a plurality of input gray-scale values, which are in one-to-one correspondence with the plurality of first display pixels, in an input image; determining a second gray-scale value of the first dimming pixel according to the first gray-scale value of the first dimming pixel and a noise reduction function, where the noise reduction function is a monotonically increasing function in an interval (0, 1), and has an intersection point P(x0, y0) with a function y=x in a case where x is in the interval (0, 1), and in a case where x is in an interval (0, x0), a function value of the noise reduction function is less than a function value y of the function y=x; obtaining a dimming gray-scale value of the first dimming pixel based on the second gray-scale value of the first dimming pixel; and determining a plurality of target gray-scale values corresponding to the plurality of first display pixels according to the plurality of input gray-scale values and the dimming gray-scale value of the first dimming pixel.

The display data processing method of the display device provided by the embodiments of the present disclosure can, on the premise of not losing the details of a dark part, pertinently reduce a backlight slope of a low gray-scale part, weaken the noise of the low gray-scale part, and solve the problem of excessive dark-field noise in the high-precision local dimming technology, so that a better visual effect can be achieved. Through the above display data processing method, the data of the input image is processed to obtain the dimming screen image data and the display screen image data, and the combination of the dimming screen image data and the display screen image data can achieve a finer display effect, a higher contrast, more natural gray-scale transition, and achieve the ultimate dark-field visual effect. In addition, the combination of the dimming screen image data and the display screen image data can improve data processing accuracy and reduce hardware memory.

Embodiments of the present disclosure will be described in detail with reference to the accompanying drawings, but the present disclosure is not limited to these specific embodiments. In addition, it should be noted that in order to keep the following description of the embodiments of the present disclosure clear and concise, the detailed description of some known functions and known components is omitted in the present disclosure.

FIG. 1 is a structural schematic diagram of a display device provided by an embodiment of the present disclosure. The display device can be any device with a display function, such as a tablet computer, a smart phone, a laptop computer, an electronic photo frame, and the like.

In an embodiment of the present disclosure, as shown in FIG. 1, the display device 10 includes a display screen 110, a dimming screen 120, and a backlight module 130. The dimming screen 120 is disposed between the backlight module 130 and the display screen 110. The backlight module 130 is disposed on a backlight side of the dimming screen 120 (i.e., a side of the dimming screen 120 away from the display screen 110) and is configured to provide backlight to the dimming screen 120. The dimming screen 120 is disposed on a backlight side of the display screen 110 (i.e., a side of the display screen 110 close to the backlight module 130) and is configured to perform backlight modulation on the display screen 110 by displaying a dimming image, and the display screen 110 is configured to present a display image.

For example, in the embodiments of the present disclosure, both the display screen 110 and the dimming screen 120 are liquid crystal screens, which can be a vertical electric field type or a horizontal electric field type, respectively, and further can be an in-plane switch (IPS) type, a fringe electric field switch (FFS) type, and multi-dimensional switch (ADS) type, and the embodiments of the present disclosure do not limit this.

The backlight module 130 provides a surface light source for display, and the surface light source can be a side-incident type or a direct type, the backlight module 130 can use a cold cathode fluorescent lamp (CCFL) or a light emitting diode (LED) as a light source, which is not limited by embodiments of the present disclosure.

Figure 2:
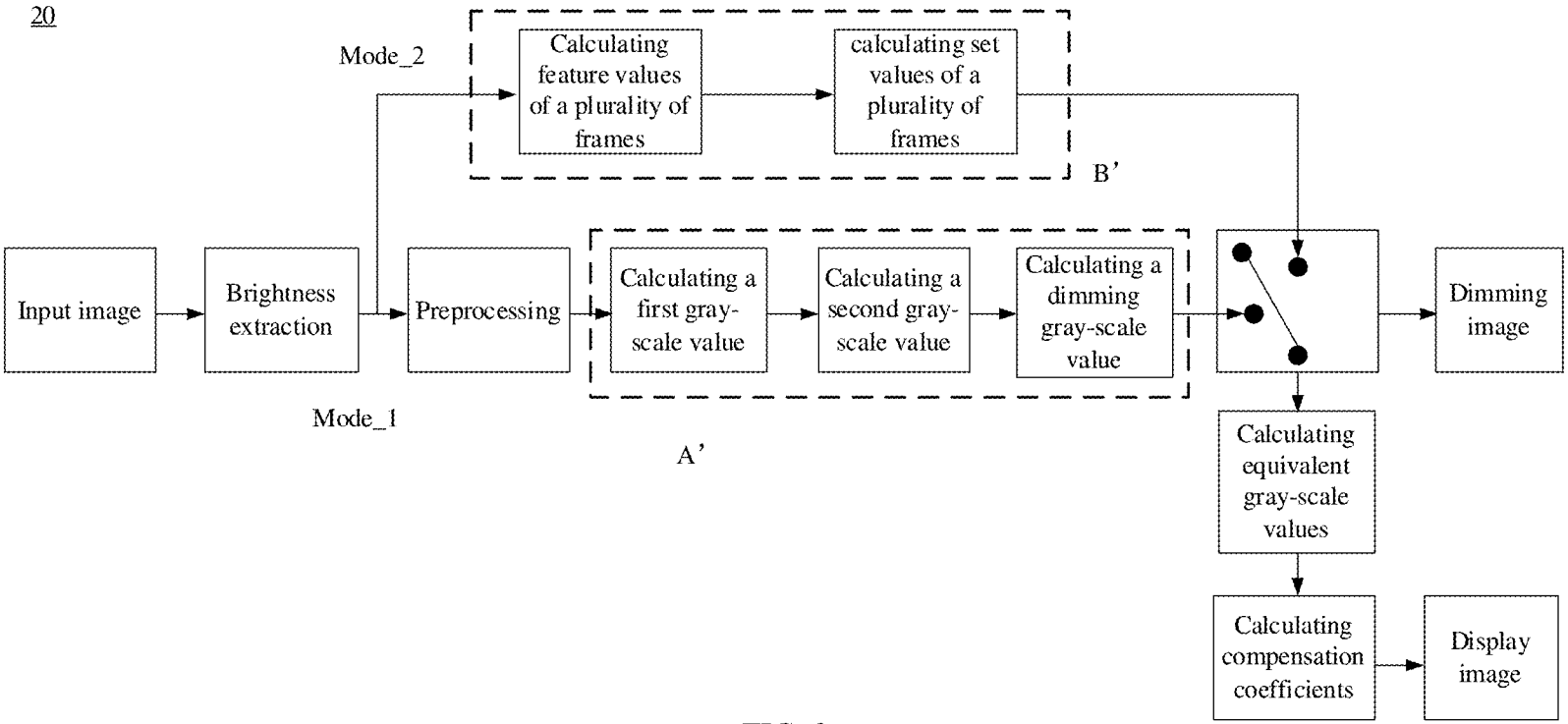
FIG. 2 is a system architecture diagram of a display data processing method of a display device provided by an embodiment of the present disclosure.

FIG. 2 is a system architecture diagram of a display data processing method of a display device provided by an embodiment of the present disclosure. For example, the display data processing method shown in FIG. 2 can be applied to the display device as shown in FIG. 1.

Through the display data processing method 20 as shown in FIG. 2, the input image from a data source can be processed through a series of processes to obtain a dimming image of the dimming screen and a display image of the display screen, the dimming image and the display image can cooperate to achieve a finer display effect, a higher contrast, more natural gray-scale transition, and achieve the ultimate dark-field visual effect. According to different examples, the data source can be a modem, a memory, a data interface (such as an USB interface, a lightning interface, etc.); for example, the input image of the data source can be adjusted as needed to adapt to the display resolution of the display screen. For example, in the case where the resolution of the input image is higher than the resolution of the display screen, the resolution of the input image needs to be reduced, or conversely, in the case where the resolution of the input image is lower than the resolution of the display screen, the resolution of the input image needs to be increased.

The display data processing method 20 as shown in FIG. 2 includes two working modes, namely, a working mode Mode_1 and a working mode Mode_2. The working mode Mode_1 corresponds to the case where a frequency of the display screen 110 and a frequency of the dimming screen 120 are consistent, and the working mode Mode_2 corresponds to the case where a frequency of the display screen 110 and a frequency of the dimming screen 120 are inconsistent.

The operation flow of the display data processing method 20 shown in FIG. 2 in two different working modes will be described in detail with reference to FIGS. 3 to 11.

Figure 3:
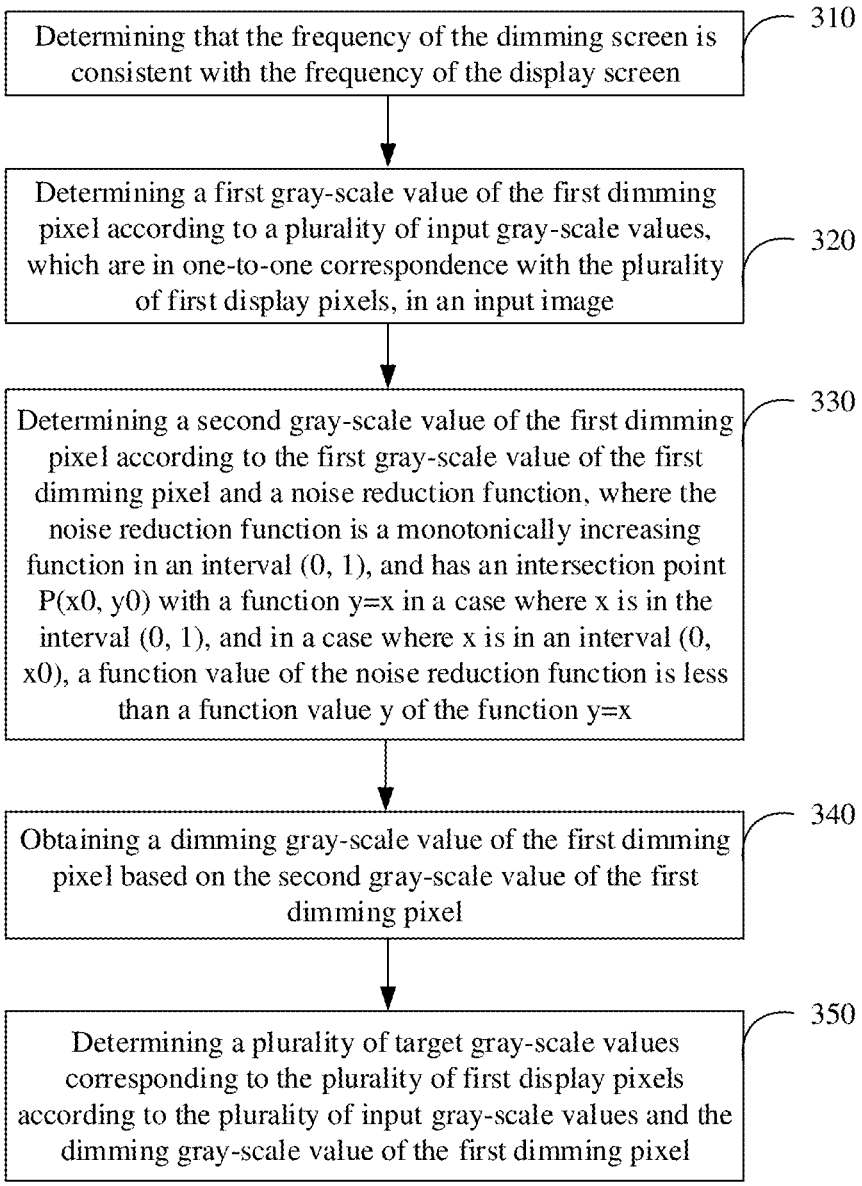
FIG. 3 is a flowchart of a display data processing method provided by an embodiment of the present disclosure.

FIG. 3 is a flowchart of a display data processing method provided by an embodiment of the present disclosure.

As shown in FIG. 3, the display data processing method 30 includes the following operations.

Step S310: determining that the frequency of the dimming screen is consistent with the frequency of the display screen;

Step S320: determining a first gray-scale value of the first dimming pixel according to a plurality of input gray-scale values, which are in one-to-one correspondence with the plurality of first display pixels, in an input image;

Step S330: determining a second gray-scale value of the first dimming pixel according to the first gray-scale value of the first dimming pixel and a noise reduction function, where the noise reduction function is a monotonically increasing function in an interval (0, 1), and has an intersection point P(x0, y0) with a function y=x in a case where x is in the interval (0, 1), and in a case where x is in an interval (0, x0), a function value of the noise reduction function is less than a function value y of the function y=x;

S340: obtaining a dimming gray-scale value of the first dimming pixel based on the second gray-scale value of the first dimming pixel; and S350: determining a plurality of target gray-scale values corresponding to the plurality of first display pixels according to the plurality of input gray-scale values and the dimming gray-scale value of the first dimming pixel.

For example, the display data processing method 30 shown in FIG. 3 corresponds to the working mode Mode_1, that is, corresponds to the case where the frequency of the dimming screen 120 and the frequency of the display screen 110 are consistent.

In the display data processing method 30 provided by at least one embodiment of the present disclosure, by introducing the noise reduction function, the backlight slope of the low gray-scale part can be pertinently reduced without losing the details of the dark part, thereby solving the problem of excessive dark-field noise in the high-precision local dimming technology. The low gray-scale part can be defined according to the actual display effect. For example, the low gray-scale part can be the smallest 0-30% in the whole gray-scale value range. For example, in the case where the range of the gray-scales displayed by the display screen is 0-255, the low gray-scale part can range from 0 gray-scale to 77 gray-scale. It should be noted that the low gray-scale part being the smallest 0-30% in the whole gray-scale value range is only an example and can be adjusted according to actual needs. The embodiments of the present disclosure are not specifically limited to this case.

For example, in an embodiment of the present disclosure, referring to FIGS. 1 and 3, the display device 10 includes a dimming screen 120 and a display screen 110, and the dimming screen 120 is disposed on the backlight side of the display screen 110 and is configured to perform backlight modulation on the display screen 110. The dimming screen 120 includes a plurality of dimming pixels, the plurality of dimming pixels comprise a first dimming pixel, the display screen 110 includes a plurality of display pixels, the plurality of display pixels comprise a plurality of first display pixels, and the first dimming pixel is configured to provide backlight modulation for the plurality of first display pixels, for example, an orthographic projection of the first dimming pixel on the display screen 110 partially overlaps with each of the plurality of first display pixels.

In step S310, in the case where the frequency of the dimming screen 120 is consistent with the frequency of the display screen 110 (i.e., in the working mode Mode_1), the dimming image of the dimming screen and the display image of the display screen can be respectively acquired according to an input image of a current frame. It should be noted that "the frequency of the dimming screen 120 is consistent with the frequency of the display screen 110" means that the dimming image displayed on the dimming screen is synchronized with the display image displayed on the display screen. For example, within a unit time (e.g., one second), the dimming screen displays 24 frame dimming images, the display screen displays 24 frame display images, and the 24 frame dimming images are in one-to-one correspondence with the 24 frame display images.

For example, all input gray-scale values in the input image are in one-to-one correspondence with all display pixels on the display screen.

For example, in an embodiment of the present disclosure, the plurality of dimming pixels in the dimming screen 120 are arranged in an array of Q rows and P columns, and the first dimming pixel is located in an a-th row and b-th column in the array formed by the plurality of dimming pixels, where Q, P, a, and b are positive integers, and $1 \leq a \leq Q$, $1 \leq b \leq P$.

For example, step S320 includes: determining a display pixel group corresponding to the first dimming pixel among the plurality of display pixels, where the display pixel group comprises the plurality of first display pixels, each of the plurality of first display pixels comprises a plurality of first sub-display pixels, and each of the plurality of input gray-scale values comprises a plurality of sub-input gray-scale values, and the plurality of sub-input gray-scale values of an input gray-scale value are in one-to-one correspondence with the plurality of first sub-display pixels of a first display pixel corresponding to the input gray-scale value; determining an input pixel gray-scale value corresponding to each of the plurality of first display pixels according to the plurality of sub-input gray-scale values of an input gray-scale value corresponding to each of the plurality of first display pixels, to obtain a plurality of input pixel gray-scale values corresponding to the plurality of first display pixels; and determining the first gray-scale value of the first dimming pixel according to the plurality of input pixel gray-scale values corresponding to the plurality of first display pixels.

For example, in an embodiment of the present disclosure, determining the display pixel group corresponding to the first dimming pixel among the plurality of display pixels may include: acquiring alignment fitting data used for recording an alignment situation between the dimming screen 120 and the display screen 110; according to the alignment fitting data, obtaining an actual corresponding relationship between the plurality of display pixels and the plurality of dimming pixels from a theoretical corresponding relationship between the plurality of display pixels and the plurality of dimming pixels; and determining the display pixel group corresponding to the first dimming pixel among the plurality of display pixels according to the actual corresponding relationship.

Figure 4A:
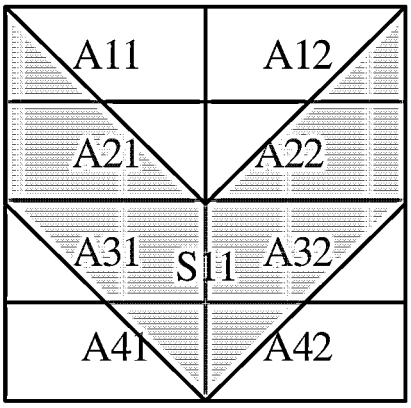
FIG. 4A is a schematic diagram of an alignment state between a display screen and a dimming screen in a display device.
Figure 4B:
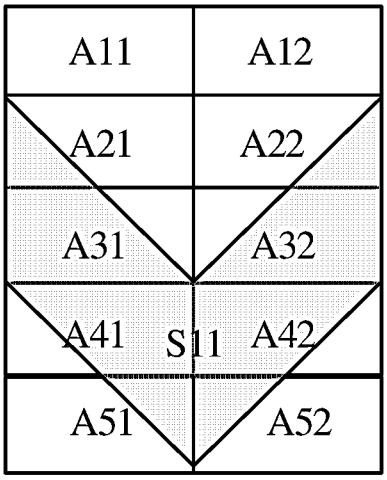
FIG. 4B is another schematic diagram of an alignment state between a display screen and a dimming screen in a display device.
Figure 4C:
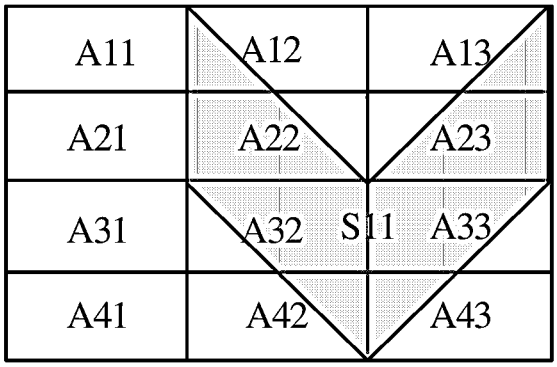
FIG. 4C is yet another schematic diagram of an alignment state between a display screen and a dimming screen in a display device.

For example, in an embodiment of the present disclosure, as shown in FIGS. 4A-4C, a shape of each of the plurality of dimming pixels in the dimming screen 120 is a "V"-shape, and a shape of each of the plurality of display pixels in the display screen 110 is rectangular. For example, in some examples, each dimming pixel corresponds to four display pixels, as shown in FIG. 4A, the display pixel group corresponding to the first dimming pixel S11 includes four first display pixels, and the four first display pixels are A11, A12, A21, and A22. For example, the four first display pixels are arranged in two rows and two columns. It should be noted that the present disclosure is not limited to this case, and each dimming pixel may also correspond to two display pixels, six display pixels, etc., according to the actual application situation.

For example, in an embodiment of the present disclosure, the alignment fitting data includes a first alignment state, a second alignment state, a third alignment state, etc., between the dimming screen 120 and the display screen 110. For example, in FIG. 4A, a plurality of display screens 110 and the dimming screen 120 are in the first alignment state, that is, there is no alignment deviation between the display screens 110 and the dimming screen 120 in a column direction and a row direction of the dimming pixels of the dimming screen 120. In this case, as shown in FIG. 4A, in theory, the display pixel group corresponding to the first dimming pixel S11 should include display pixels A11, A12, A21, and A22, that is, the theoretical corresponding relationship represents that the first dimming pixel S11 corresponds to the display pixels A11, A12, A21, and A22. Based on the above-mentioned first alignment state (that is, there is no alignment deviation in the row direction and the column direction), it can be known that in fact, the display pixel group corresponding to the first dimming pixel S11 includes the display pixels A11, A12, A21, and A22, that is, the actual corresponding relationship represents that the first dimming pixel S11 corresponds to the display pixels A11, A12, A21, and A22.

For example, in FIG. 4B, the plurality of display screens 110 and the dimming screen 120 are in the second alignment state, that is, in the column direction of the dimming pixels of the dimming screen 120, the display screens 110 is offset by one row of display pixels upward relative to the dimming screen 120. In this case, as shown in FIG. 4B, in theory, the display pixel group corresponding to the first dimming pixel S11 includes display pixels A11, A12, A21, and A22, that is, the theoretical corresponding relationship represents that the first dimming pixel S11 corresponds to the display pixels A11, A12, A21, and A22. However, based on the above-mentioned second alignment state, it can be seen that in fact, the display pixel group corresponding to the first dimming pixel S11 includes display pixels A21, A22, A31, and A32, that is, the actual corresponding relationship represents that the first dimming pixel S11 corresponds to the display pixels A21, A22, A31, and A32.

For example, in FIG. 4C, the plurality of display screens 110 and the dimming screen 120 are in the third alignment state, that is, in the row direction of the dimming pixels of the dimming screen 120, the display screens 110 is offset by one column of display pixels to the left relative to the dimming screen 120. In this case, as shown in FIG. 4C, in theory, the display pixel group corresponding to the first dimming pixel S11 includes display pixels A11, A12, A21, and A22, that is, the theoretical corresponding relationship represents that the first dimming pixel S11 corresponds to the display pixels A11, A12, A21, and A22. However, based on the above-mentioned third alignment state, it can be seen that the display pixel group corresponding to the first dimming pixel S11 actually includes display pixels A12, A13, A22, and A23, that is, the actual corresponding relationship represents that the first dimming pixel S11 corresponds to the display pixels A12, A13, A22, and A23.

It should be noted that although FIG. 4B only shows that the display screen 110 is offset by one row of the display pixels upward relative to the dimming screen 120, the display screen 110 can also is offset by one row of the display pixels downward relative to the dimming screen 120. Similarly, although FIG. 4C only shows that the display screen 110 is offset by one column of the display pixels to the left relative to the dimming screen 120, the display screen 110 can also is offset by one column of the display pixels to the right relative to the dimming screen 120, the embodiments of the present disclosure do not specifically limit this. Various alignment deviation states between the display screen 110 and the dimming screen 120 can also exist at the same time. For example, in some embodiments, the display screen 110 is offset by one row of the display pixels downward relative to the dimming screen 120, and at the same time, the display screen 110 is offset by one column of the display pixels to the left relative to the dimming screen 120.

It should also be noted that the alignment deviation between the display screen 110 and the dimming screen 120 is one row of the display pixels in the column direction of the plurality of display pixels of the display screen 110, and the alignment deviation between the display screen 110 and the dimming screen 120 is one column of the display pixels in the row direction of the plurality of display pixels of the display screen 110, but the embodiments of the present disclosure are obviously not limited to this case. For example, in the column direction, the display screen 110 may be offset by half a row of the display pixels relative to the dimming screen 120, or the display screen 110 may deviate from the dimming screen 120 by a plurality of rows of the display pixels. In the row direction, the display screen 110 may be offset by half a column of the display pixels relative to the dimming screen 120, or the display screen 110 may be offset by a plurality of columns of the display pixels relative to the dimming screen 120. Embodiments of the present disclosure are not particularly limited to this case.

It should be noted that the display pixel group corresponding to the first dimming pixel among the plurality of display pixels can also be determined by other methods, and the embodiments of the present disclosure are not particularly limited to this case.

For example, each first display pixel (e.g., A11, A12, A21, or A22 in FIGS. 4A-4C) includes a plurality of sub-display pixels (e.g., R, G, and B sub-display pixels as shown in FIG. 1), and each input gray-scale value includes a plurality of sub-input gray-scale values, the plurality of sub-input gray-scale values of the input gray-scale value are in one-to-one correspondence with the plurality of sub-display pixels of the first display pixel corresponding to the input gray-scale value. For example, the plurality of sub-display pixels of the first display pixel A11 are in one-to-one correspondence with the plurality of sub-input gray-scale values of the input gray-scale value corresponding to the first display pixel A11, the plurality of sub-display pixels of the first display pixel A12 are in one-to-one correspondence with the plurality of sub-input gray-scale values of the input gray-scale value corresponding to the first display pixel A12, and so on.

For example, in an embodiment of the present disclosure, the input gray-scale value corresponding to the first display pixel includes a first sub-input gray-scale value Input(R), a second sub-input gray-scale value Input(G), and a third sub-input gray-scale value Input(B), then the input pixel gray-scale value corresponding to the first display pixel (e.g., A11) can be determined as the maximum value among the first sub-input gray-scale value Input(R), the second sub-input gray-scale value Input(G), and the third sub-input gray-scale value Input(B) (this step is called "brightness extraction" in FIG. 2), the input pixel gray-scale value corresponding to the first display pixel (e.g., A11) can also be determined as an average value (e.g., arithmetic average value or weighted average value, etc.) of the first sub-input gray-scale value Input(R), the second sub-input gray-scale value Input(G), and the third sub-input gray-scale value Input(B); and the input pixel gray-scale value corresponding to the first display pixel (e.g., A11) can also be determined as any one selected from a group consisting of the first sub-input gray-scale value Input(R), the second sub-input gray-scale value Input(G), and the third sub-input gray-scale value Input(B), etc. The brightness extraction operation is performed on the plurality of first display pixels, thereby obtaining a plurality of input pixel gray-scale values which are in one-to-one correspondence with the plurality of first display pixels (for example, A11, A12, A21, and A22 in FIGS. 4A-4C). It should be noted that the embodiments of the present disclosure do not specifically limit the method of obtaining the input pixel gray-scale value, and the method of obtaining the input pixel gray-scale value can be set according to actual needs.

For example, in an embodiment of the present disclosure, the plurality of first display pixels are arranged in an array of nt rows and mt columns, nt is a positive integer and mt is a positive integer. For example, determining the first gray-scale value of the first dimming pixel according to the plurality of input pixel gray-scale values corresponding to the plurality of first display pixels, comprises: according to the plurality of input pixel gray-scale values corresponding to the plurality of first display pixels, calculating nt row sampling values of the nt rows corresponding to the plurality of first display pixels by a first group of calculation formulas, and determining the first gray-scale value of the first dimming pixel as the maximum value of the nt row sampling values corresponding to the plurality of first display pixels.

For example, nt row includes an n-th row, for a row sampling value of the n-th row in the nt rows, the first group of calculation formulas corresponding to the row sampling value of the n-th row is as follows:

$$S1(n)=(NA*\max(n)>(2M-1))?(2M-1):NA*\max(n);$$

$$S2(n)=(NE*\mathrm{mean}(n)>(2M-1))?(2M-1):NE*\mathrm{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and VL(n) is the row sampling value of the n-th row.

It should be noted that M represents a data length of the first gray-scale value, can be equal to 8, 10, 12, etc., that is to say, if M=8, the data length of the first gray-scale value is 8 bits, and if M=10, the data length of the first gray-scale value is 10 bits. Embodiments of the present disclosure are not particularly limited to this case, and the data length of the first gray-scale value can be set according to actual requirements.

For example, in an embodiment of the present disclosure, referring to FIG. 4A, nt=2 and mt=2. That is, the plurality of first display pixels (A11, A12, A21, and A22) are arranged in an array of 2 rows and 2 columns. A row sampling value of the first row and a row sampling value of the second row in the plurality of first display pixels (A11, A12, A21, and A22) are calculated respectively by using the first group of calculation formulas.

For example, in the case where M=10, the row sampling value of the first row (that is, n=1) is calculated first as following:

$$S1(1)=(NA*\max(1)>1023)?1023:NA*\max(1);$$

$$S2(1)=(NE*\mathrm{mean}(1)>1023?1023:NE*\mathrm{mean}(1);$$

$$VL(1)=KL(1)*(KA*S1(1)+(1-KA)*S2(1));$$

where max(1) is a maximum value of the input pixel gray-scale values corresponding to the first display pixels (A11 and A12) in the first row, mean(1) is an average value of the input pixel gray-scale values corresponding to the first display pixels (A11 and A12) in the first row; VL(1) represents the row sampling value of the first row; S1(1) represents a result of overflow judgment on NA*max(1), and S2(1) represents a result of overflow judgment on NE*mean(1).

For example, the input pixel gray-scale value corresponding to the first display pixel A11 is denoted as m11, and the input pixel gray-scale value corresponding to the first display pixel A12 is denoted as m12. max(1)=max(m11, m12). For mean(1), the sum of m11 and m12 is calculated, after the result (i.e., the sum of m11 and m12) is shifted to the right by 1 bit, 10 bits of data are truncated and retained, thus obtaining the average value mean(1) of m11 and m12.

Similarly, the row sample value of the second row (i.e., n=2) is calculated as following:

$$S1(2)=(NA*\max(2)>1023)?1023:NA*\max(2);$$

$$S2(2)=(NE*\mathrm{mean}(2)>1023?1023:NE*\mathrm{mean}(2);$$

$$VL(2)=KL(2)*(KA*S1(2)+(1-KA)*S2(2));$$

where max(2) is a maximum value of the input pixel gray-scale values corresponding to the first display pixels (A21 and A22) in the second row, mean(2) is an average value of the input pixel gray-scale values corresponding to the first display pixels (A21 and A22) in the second row; VL(2) represents the row sampling value of the second row; S1(2) represents a result of overflow judgment on NA*max (2), and S2(2) represents a result of overflow judgment on NE*mean(2).

For example, the input pixel gray-scale value corresponding to the first display pixel A21 is denoted as m21, and the input pixel gray-scale value corresponding to the first display pixel A22 is denoted as m22. max(2)=max(m21, m22). For mean(2), the sum of m21 and m22 is calculated, after the result (i.e., the sum of m21 and m22) is shifted to the right by 1 bit, 10 bits of data are truncated and retained, thus obtaining the average value mean(2) of m21 and m22.

For example, the first gray-scale value of the first dimming pixel S11 is the maximum value of VL(1) and VL(2), that is, if VL(1) is greater than VL(2), the first gray-scale value $y_{sub1}$ of the first dimming pixel S11 is VL (1); if VL(1) is less than VL (2), the first gray-scale value $y_{sub1}$ of the first dimming pixel S11 is VL(2), if VL(1) is equal to VL(2), the first gray-scale value $y_{sub1}$ of the first dimming pixel S11 is either VL(1) or VL(2).

It should be noted that NA, NE, KA, and KL(n) in the above first group of formulas are all configurable parameters, and NA=NE=KA=1, KL(n)=0.5 or 0.25 specified in the embodiments of the present disclosure are only exemplary, and the present disclosure does not specifically limit the actual values of NA, NE, KA, and KL(n).

For example, in an embodiment of the present disclosure, the determining the first gray-scale value of the first dimming pixel according to the plurality of input pixel gray-scale values corresponding to the plurality of first display pixels, comprises: determining the first gray-scale value of the first dimming pixel as a maximum value among the plurality of input pixel gray-scale values.

For example, in an embodiment of the present disclosure, referring to FIG. 4A, the first dimming pixel S11 corresponds to the plurality of first display pixels (A11, A12, A21, and A22), and the plurality of first display pixels (A11, A12, A21, and A22) are arranged in an array of 2 rows and 2 columns. For example, the input pixel gray-scale value corresponding to the first display pixel A11 is denoted as m11, and the input pixel gray-scale value corresponding to the first display pixel A12 is denoted as m12. The input pixel gray-scale value corresponding to the first display pixel A21 is denoted as m21, and the input pixel gray-scale value corresponding to the first display pixel A22 is denoted as m22. The first gray-scale value of the first dimming pixel S11 may be determined as the maximum value among the plurality of input pixel gray-scale values, that is, the maximum value among m11, m12, m21, and m22.

It should be noted that in other embodiments of the present disclosure, the average value (e.g., the arithmetic average value or weighted average value, etc.) of the plurality of input pixel gray-scale values (e.g., m11, m12, m21, and m22) can also be determined as the first gray-scale value of the first dimming pixel S11, the embodiments of the present disclosure do not specifically limit this, and the first gray-scale value of the first dimming pixel S11 can be set according to actual needs.

For example, in an embodiment of the present disclosure, in step S330, the noise reduction function adopted in the display data processing method 30 may be:

$$y_{sub2}=1/(1+e^{\wedge}(A-y_{sub1}*B)) \quad \text{equation (1)}$$

where A and B are noise reduction parameters and are constants, $y_{sub1}$ represents the first gray-scale value of the first dimming pixel, and $y_{sub2}$ is a function value of the noise reduction function and represents the second gray-scale value of the first dimming pixel. A and B are variable parameters, so that a suppression degree of the dark-field noise can be adjusted by changing the value of A and the value of B.

For example, in an embodiment of the present disclosure, A=4 and B=14.

Figure 5:
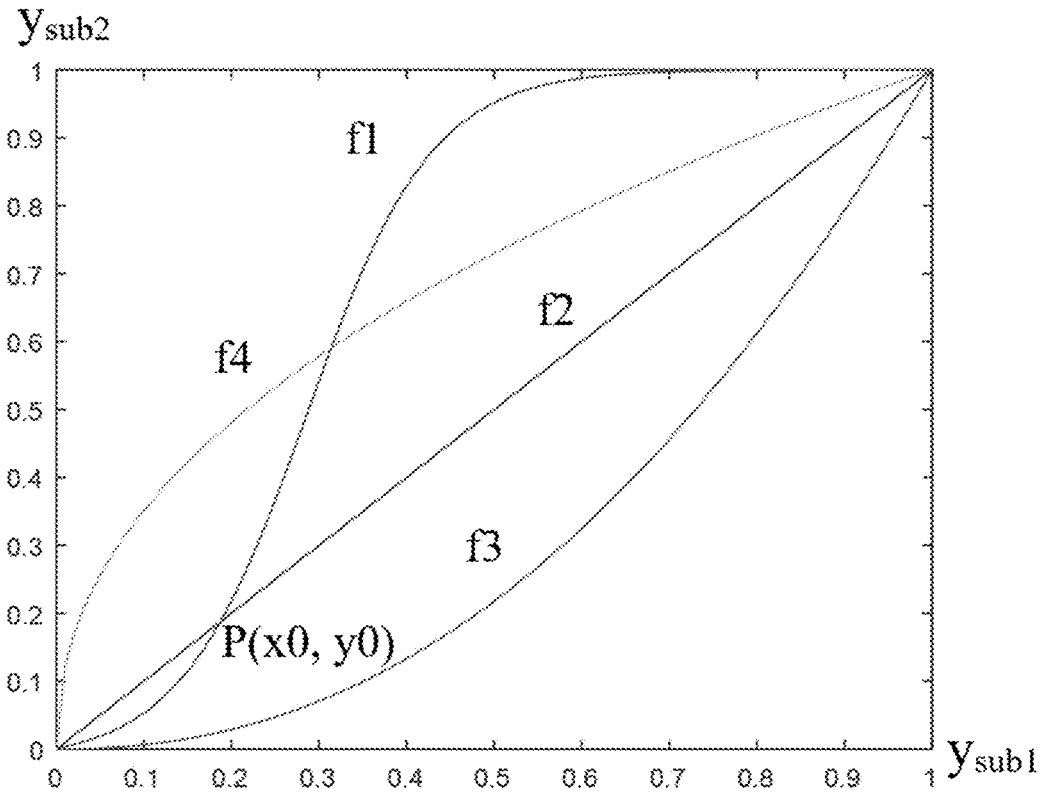
FIG. 5 is a curve comparison diagram of a noise reduction function and other functions provided by an embodiment of the present disclosure.

For example, as shown in FIG. 5, the noise reduction function as shown in equation (1), which plays a role in suppressing dark-field noise, is described by taking A=4 and B=14 as an example.

In FIG. 5, an abscissa axis represents the first gray-scale value $y_{sub1}$ of the first dimming pixel, an ordinate axis represents the second gray-scale value $y_{sub2}$ of the first dimming pixel, a curve f1 represents the noise reduction function as shown in equation (1), a curve f2 represents the function y=x, a curve f3 represents a function y=x^(2.2), and a curve f4 represents a conventionally used function y=x^(1/2.2). It can be seen from FIG. 5 that in the low gray-scale part, for example, when the abscissa is in an interval (0, 1), the noise reduction function represented by the curve f1 is a monotonically increasing function and has an intersection point P(x0, y0) with the function y=x, for example, in the example shown in FIG. 5, x0 is about 0.19. The function value $y_{sub2}$ of the noise reduction function is less than the function value y of the function y=x in the case where the abscissa is in the interval (0, x0), that is, the curve f1 is lower than the curve f2 in the case where the abscissa is in the interval (0, x0), so that such a noise reduction function $y_{sub2}$ can suppress dark-field noise, and in the interval (0, x0), the smaller the value of the noise reduction function $y_{sub2}$ (i.e., the lower the curve f1), the stronger the effect of suppressing the dark-field noise, while the curve f4 is above the curve f2, and cannot suppress the dark-field noise.

In at least one example, as shown in FIG. 5, in the interval (0, 1), the curve f1 is further larger than a Gamma curve f3 of the display screen 110, thereby avoiding the loss of dark details caused by low gray-scale overflow when compensating the display screen 110.

For example, in an embodiment of the present disclosure, step S340 includes processing the second gray-scale value $y_{sub2}$ of the first dimming pixel S11 to obtain the dimming gray-scale value $y_{sub3}$ of the first dimming pixel S11.

For example, in an embodiment of the present disclosure, processing the second gray-scale value $y_{sub2}$ of the first dimming pixel S11 includes performing a smooth filtering operation or a bright line detection operation on the second gray-scale value $y_{sub2}$ of the first dimming pixel S11.

For example, the bright line detection operation includes performing a padding operation (e.g., filling 2 circles of 0 on an outer circle of the whole dimming screen data) on the dimming screen data (e.g., the second gray-scale values $y_{sub2}$ of the plurality of dimming pixels), and traversing new dimming screen data that is obtained after padding. For example, a template with 3*3 pixels is taken each time and is denoted as Tmp, the gray-scale value of a central pixel of the Tmp template is denoted as Cen, and the maximum gray-scale value in the Tmp template is denoted as Max.

It should be noted that Cen used in the embodiments of the present disclosure can refer to both the central pixel in the Tmp template and the gray-scale value of the central pixel.

Figure 6A:
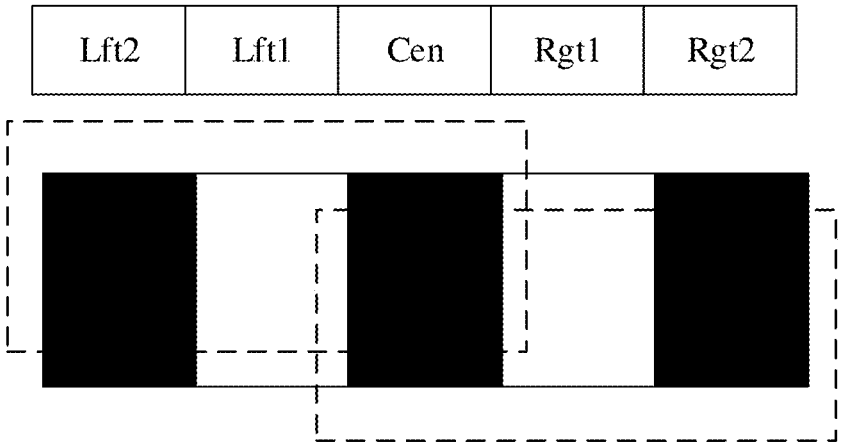
FIG. 6A is a schematic diagram for illustrating a bright line detection operation provided by an embodiment of the present disclosure.

As shown in FIG. 6A, the pixels located on the left side of the central pixel Cen are denoted as Lft1 and Lft2, the central pixel Cen, the pixel Lft1, and the pixel Lft2 are adjacent to each other in turn, and the pixel Lft1 is located between the pixel Lft2 and the central pixel Cen; while the pixels located on the right side of the central pixel Cen are denoted as Rgt1 and Rgt2, respectively, and the central pixel Cen, the pixel Lft1, and the pixel Lft2 are adjacent to each other in turn, and the pixel Rgt1 is located between the pixel Rgt2 and the central pixel Cen. It should be noted that Lft1, Lft2, Rgt1, and Rgt2 used here can refer to either a pixel or a gray-scale value of the pixel.

For example, the central pixel Cen and the pixels Lft1, Lft2, Rgt1, and Rgt2 on the left side and the right side are taken out, and the bright line detection operation is performed on a total of 1*5 pixels. In the case where the central pixel Cen and the pixels Lft1, Lft2, Rgt1, and Rgt2 form a combination of "black and white and black" (where "black" means that a gray-scale value of a current pixel is lower than a first threshold, and "white" means that the gray-scale value of the current pixel is higher than a second threshold), Max in Tmp is assigned to the central pixel Cen, thus expanding the bright region outward.

As shown in FIG. 6A, the pixel gray-scale value of the pixel Lft1 is represented as white, the pixel gray-scale value of the pixel Lft2 is represented as black, and the pixel gray-scale value of the central pixel Cen is represented as black, that is, the pixel Lft2, the pixel Lft1, and the central pixel Cen constitute a combination of "black and white and black", similarly, the pixel gray-scale value of the pixel Rgt1 is represented as white, the pixel gray-scale value of the pixel Rgt2 is represented as black, and the pixel gray-scale value of the central pixel Cen is represented as black, that is, the pixel Rgt2, the pixel Rgt1, and the central pixel Cen constitute a combination of "black and white and black".

For example, the smooth filtering operation includes performing padding operation (e.g., filling 2 circles of 0 on an outer circle of the whole dimming screen data) on the dimming screen data (e.g., the second gray-scale value $y_{sub2}$ of the plurality of dimming pixels), and traversing new dimming screen data that is obtained after padding. For example, a template with 3*3 pixels is taken each time and is denoted as Tmp, a gray-scale value of a central pixel of the Tmp template is denoted as Cen, and the maximum gray-scale value in the Tmp template is denoted as Max. If the above-mentioned "black and white" combination does not appear in the Tmp template, and the value of the central pixel Cen is not equal to Max, it can be considered to perform the smooth filtering operation on the gray-scale value of the central pixel Cen to prevent the gray-scale value difference between adjacent pixels from being too large.

For example, the embodiments of the present disclosure provide the following algorithm to represent the specific process of data processing from the second gray-scale value $y_{sub2}$ to the third gray-scale value $y_{sub3}$.

Figures 6B, 6C, 7:
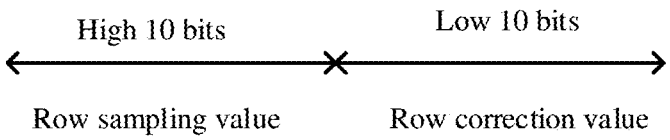
FIG. 6B is a distribution diagram of pixel gray-scale values of a 3*3 matrix provided by an embodiment of the present disclosure.
FIG. 6C is a distribution diagram of pixel gray-scale values of another 3*3 matrix provided by an embodiment of the present disclosure.
FIG. 7 is a schematic diagram of a data storage method provided by an embodiment of the present disclosure.

If ((Cen==Max)||((Cen<Th1) && ((Lft2<Th1 && Lft1>Th2)||(Rgt2<Th1 && Rgt1>Th2))) $y_{sub3}$=Max(Tmp)
else
If Tmp*Flt>Max(Tmp) $y_{sub3}$=Max(Tmp)
else
$y_{sub3}$=Tmp*Flt
end Combined with the description about FIG. 6A, the Tmp represents a 3*3 pixel matrix (as shown in FIGS. 6B and 6C), the gray-scale value of the central pixel of the Tmp template is denoted as Cen, and the maximum gray-scale value in the Tmp template is denoted as Max. The pixels located on the left side of the central pixel Cen are denoted as Lft1 and Lft2, the central pixel Cen, the pixel Lft1, and the pixel Lft2 are adjacent in turn, and the pixel Lft1 is located between the pixel Lft2 and the central pixel Cen, while the pixels located on the right side of the central pixel Cen are denoted as Rgt1 and Rgt2, respectively, the central pixel Cen, the pixel Rgt1, and the pixel Rgt2 are adjacent in sequence, and the pixel Rgt1 is located between the pixel Rgt2 and the central pixel Cen. It should be noted that Lft1, Lft2, Rgt1, and Rgt2 used here can refer to either a pixel or a gray-scale value of the pixel. Flt denotes a filter matrix, for example, the filter matrix Flt may be a matrix [0.05, 0.1, 0.05; 0.1, 0.4, 0.1; 0.05, 0.1, 0.05], etc.

For example, the above algorithm shows that if the gray-scale value Cen of the central pixel is equal to the maximum gray-scale value Max in the 3*3 template TMP, or if the gray-scale value Cen of the central pixel is less than the first threshold Th1, and Lft2 is less than the first threshold Th1 and Lft1 is larger than the second threshold Th2, or if the gray-scale value Cen of the central pixel is less than the first threshold Th1, and Rgt2 is less than the first threshold Th1 and Rgt1 is larger than the second threshold Th2, $y_{sub3}$=Max(Tmp); otherwise, if the value obtained by multiplying the 3*3 Tmp template by the filter matrix Flt is greater than the maximum gray-scale value Max in the Tmp template, $y_{sub3}$=Max(Tmp); Otherwise, $y_{sub3}$=Tmp*Flt.

The above algorithm will be described below with reference to FIGS. 6B and 6C. FIGS. 6B and 6C are respectively the pixel gray-scale value distribution diagrams of the 3*3 matrix provided by the embodiments of the present disclosure, in which a pixel at the circle is the central pixel Cen, and the calculation result obtained by processing the pixel at the circle is a third gray-scale value $y_{sub3}$.

FIG. 6B is a Tmp template of 3*3 pixels, the gray-scale value of the central pixel Cen of the Tmp template is 102, and the maximum gray-scale value Max of the Tmp template is 906. For example, in this example, the first threshold Th1 is 200 and the second threshold Th2 is 400. For the example as shown in FIG. 6B, the gray-scale value Lft1 of the pixel Lft1 is 309, and the gray-scale value Rgt1 of the pixel Rgt1 is 500, so that Cen<Th1, Lft1>Th2, Rgt1>Th2, and due to the filling operation (for example, filling 2 circles of 0 on the outer circle of the whole dimming screen data), Lft2<Th1, Rgt2<Th1. Therefore, the maximum gray-scale value Max is assigned to the central pixel Cen, and in this case, the gray-scale value of the central pixel Cen becomes 906, so that $y_{sub3}$=Max(Tmp)=906 can be calculated. For the 3*3 Tmp as shown in FIG. 6C, a center value Cen of the 3*3 Tmp is 202, a maximum value Max of the 3*3 Tmp is 906, a gray-scale value Lft1 of the pixel Lft1 of the 3*3 Tmp is 309, and a gray-scale value Rgt1 of the pixel Rgt1 of the 3*3 Tmp is 500, therefore, Cen>Th1 and Cen is not equal to Max, in this case, it is necessary to filter the central pixel Cen. For example, in some examples, the filter matrix Flt may be a matrix [0.05, 0.1, 0.05; 0.1, 0.4, 0.1; 0.05, 0.1, 0.05], then Tmp*Flt=391.9<Max, so $y_{sub3}$=Tmp*Flt=391.9 is calculated. It should be noted that the filter matrix Flt and the Tmp template can have the same number of elements. For example, if the Tmp template is an O1*O2 matrix, correspondingly, the filter matrix Flt is also an O1*O2 matrix.

It should be noted that the filter matrix Flt provided in the embodiment of the present disclosure is only exemplary, and the specific data in the filter matrix Flt can be set according to actual requirements.

Through the above method, the dimming gray-scale value $y_{sub3}$ of the first dimming pixel can be calculated to obtain the data of the dimming image of the current frame of the dimming screen, that is, based on the calculated dimming gray-scale values $y_{sub3}$ of the plurality of dimming pixels, the dimming screen can display the dimming image, thereby achieving backlight modulation.

For steps S320, S330, and S340, the embodiment of the present disclosure also provides another implementation, and the implementation can improve the data processing accuracy and reduce the hardware memory.

For example, in an embodiment of the present disclosure, step S320 includes according to the plurality of input pixel gray-scale values corresponding to the plurality of first display pixels, calculating nt row sampling values of the nt rows corresponding to the plurality of first display pixels by a first group of calculation formulas.

For example, for a row sampling value of an n-th row in the nt rows, the first group of calculation formulas comprises:

$$S1(n)=(NA*\max(n)>(2M-1))?(2M-1):NA*\max(n);$$

$$S2(n)=(NE*\mathrm{mean}(n)>(2M-1))?(2M-1):NE*\mathrm{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and the row sampling value of the n-th row takes high M-bit of VL(n).

nt row correction values of the nt rows are calculated by a second calculation formula, and for a row correction value of the n-th row, the second calculation formula comprises:

$$VLX(n)=KX(n)*(KA*S1(n)+(1-KA)*S2(n)),$$

where KX(n)=0.5 or 0.25, and the row correction value of the n-th row takes high M-bit data of VLX(n).

According to the nt row sampling values and the nt row correction values, nt row final values of the nt rows are calculated by a third calculation formula.

For a row final value of the n-th row, the third calculation formula comprises:

$$VLF(n)=(VL(n)<<M)+VLX(n);$$

where VLF(n) represents the row final value of the n-th row.

Maximum high M-bit data among nt high M-bit data in the nt row final values and maximum low M-bit data among nt low M-bit data in the nt row final values are taken to obtain the first gray-scale value of the first dimming pixel. A length of the first gray-scale value of the first dimming pixel is 2*M bits.

It should be noted that VL(n)<<M represents that the row sampling value VL(n) with a data length of M bits is shifted to the left by M bits and finally stored as the high M-bit of the row final value VLF(n) with a data length of 2*M bits, so that the row correction value VLX(n) with a data length of M bits is finally stored as the low M-bit of the row final value VLF(n) with a data length of 2*M bits.

It should be noted that the low M-bit data of the first gray-scale value of the first dimming pixel here represents the row correction value that plays a role on the dimming pixel that is located directly above the first dimming pixel in the previous row adjacent to the current row where the first dimming pixel is located. For example, if the first dimming pixel is located in a third row and a first column in the 3*3 dimming pixel matrix, the low M-bit data of the first gray-scale value of the first dimming pixel represents the row correction value that plays a role on the dimming pixel located in a second row and the first column.

It should be noted that the above KX(n)=0.5 or 0.25 is only an example and KX(n) can be set according to actual needs, and the embodiments of the present disclosure do not specifically limit this.

For example, in an example, as shown in FIG. 4A, referring to the above embodiments, the plurality of first display pixels A11, A12, A21, and A22 corresponding to the first dimming pixel S11 are arranged in a matrix of 2 rows and 2 columns. In the case where M is 10, VL(1) and VL(2) are obtained by the first group of calculation formulas in combination with the above-mentioned related contents, and the row sampling value of the first row takes the high ten-bit data of VL(1), and the row sampling value of the second row takes the high ten-bit data of VL(2).

The row correction value of the first row is calculated through the second calculation formula:

$$VLX(1)=KX(1)*(KA*S1(1)+(1-KA)*S2(1))$$

where KX(1)=0.5 or 0.25, S1(1) represents the result of overflow judgment on NA*max(1), S2(1) represents the result of overflow judgment on NE*mean(1), and the row correction value of the first row takes the high ten-bit data of VLX(1).

The row final value of the first row is calculated by the third calculation formula:

$$VLF(1)=(VL(1)<<10)+VLX(1);$$

where VLF(1) is the row final value of the first row.

And, the row final value is stored by the way as shown in FIG. 7. That is, the row sampling value (i.e., the high ten-bit data of VL(1)) of the first row with a data length of 10 bits is finally stored as the high ten-bit of the row final value VLF(n) with a data length of 20 bits, and the row correction value (i.e., the high ten-bit data of VLX(1)) of the first row with a data length of 10 bits is finally stored as the low ten-bit of the row final value VLF(n) with a data length of 20 bits.

Similarly, the row correction value of the second row is calculated by the following formula:

$$VLX(2)=KX(2)*(KA*S1(2)+(1-KA)*S2(2))$$

where KX(2)=0.5 or 0.25, S1(2) represents the result of overflow judgment on NA*max(2), S2(2) represents the result of overflow judgment on NE*mean(2), and the row correction value of the second row takes the high ten-bit data of VLX(2).

The row final value of the second row is calculated by the third calculation formula:

$$VLF(2)=(VL(2)<<10)+VLX(2);$$

Then, the row final value VLF(2) of the second row is stored by the way as shown in FIG. 7, which is not repeated here.

Then, the high ten-bit data of VLF(1) are compared with the high ten-bit data of VLF(2), and the larger one of the high ten-bit data of VLF(1) and the high ten-bit data of VLF(2) is stored in the high ten-bit of the first gray-scale value $y_{sub1}$ of the first dimming pixel S11. The low ten-bit data of VLF(1) and the low ten-bit data of VLF(2) are compared, and the larger one of the low ten-bit data of VLF(1) and the low ten-bit data of VLF(2) is stored in the low ten-bit of the first gray-scale value $y_{sub1}$ of the first dimming pixel S11. The first gray-scale value $y_{sub1}$ of the first dimming pixel S11 with a length of 20 bits is finally obtained.

For example, in an embodiment, corresponding to step S330, after obtaining the first gray-scale value of the first dimming pixel with a length of 2*M bits, the second gray-scale value of the first dimming pixel can be determined according to the first gray-scale value and the noise reduction function.

For example, step S330 includes: taking high M-bit data of the first gray-scale value of the first dimming pixel, and calculating high M-bit data of the second gray-scale value of the first dimming pixel by the noise reduction function; and taking low M-bit data of the first gray-scale value of the first dimming pixel, and calculating low M-bit data of the second gray-scale value of the first dimming pixel by the noise reduction function. In this way, a length of the second gray-scale value of the first dimming pixel is 2*M bits.

For example, in an example of the present disclosure, M=10, after obtaining the first gray-scale value $y_{sub1}$ of the first dimming pixel S11 with a length of 20 bits, the high ten-bit data of the first gray-scale value $y_{sub1}$ of the first dimming pixel S11 is taken, and the curve f1 (i.e., S-shaped curve) mapping as shown in FIG. 5 is performed on the high ten-bit data of the first gray-scale value $y_{sub1}$ through the above-mentioned noise reduction function (as shown in Equation (1)), the mapped values are taken as the high ten-bit data in the second gray-scale value $y_{sub2}$. The low ten-bit data of the first gray-scale value $y_{sub1}$ is taken, and similarly, the curve f1 mapping as shown in FIG. 5 is performed on the low ten-bit data of the first gray-scale value $y_{sub1}$ through the above noise reduction function, and the mapped values are taken as the low ten-bit data of the second gray-scale value $y_{sub2}$. So that the second gray-scale value $y_{sub2}$ of the first dimming pixel S11 with a length of 20 bits is obtained.

For example, in an embodiment of the present disclosure, in addition to the first dimming pixel, the plurality of dimming pixels also include a second dimming pixel. The second dimming pixel is located in a (a+1)-th row and b-th column in the array formed by the plurality of dimming pixels.

For example, in an embodiment of the present disclosure, after obtaining the second gray-scale value of the first dimming pixel with a length of 2*M bits, step S340 includes: performing a data preparation operation on the second gray-scale value of the first dimming pixel to obtain an intermediate value of the first dimming pixel; and obtaining the dimming gray-scale value of the first dimming pixel based on the intermediate value of the first dimming pixel.

For example, the data preparation operation includes: taking the high M-bit data of the second gray-scale value of the first dimming pixel as first data, and taking the low M-bit data of the second gray-scale value of the second dimming pixel as second data. The length of the first data and the length of the second data are both M bits. A weight value of the first dimming pixel is obtained by a fourth calculation formula. The fourth calculation formula is as follows:

$$Q=KS*LD+(1-KS)*HD;$$

where HD is the first data, LD is the second data, KS=0.5, and Q is the weight value of the first dimming pixel.

The intermediate value of the first dimming pixel is obtained by a fifth calculation formula. The fifth calculation formula is as follows:

$$T=KQ*Q+(1-KQ)*Z;$$

where Z is a maximum value between the first data HD and the second data LD, and KQ=0.5, and the intermediate value of the first dimming pixel is high M-bit data of T.

It should be noted that in the embodiment of the present disclosure, KQ=0.5 and KS=0.5 are only exemplary, and actual values of KQ and KS can be set according to actual requirements, and are not specifically limited by the embodiments of the present disclosure.

For example, obtaining the dimming gray-scale value of the first dimming pixel based on the intermediate value of the first dimming pixel includes: performing a smooth filtering operation or a bright line detection operation on the intermediate value of the first dimming pixel to obtain the dimming gray-scale value of the first dimming pixel.

It should be noted that, in the embodiments of the present disclosure, for the processing of the intermediate value of the first dimming pixel with the length of M bits, reference can be made to the embodiments described with respect to FIGS. 6A-6C, and will not be repeated here.

Figure 8:
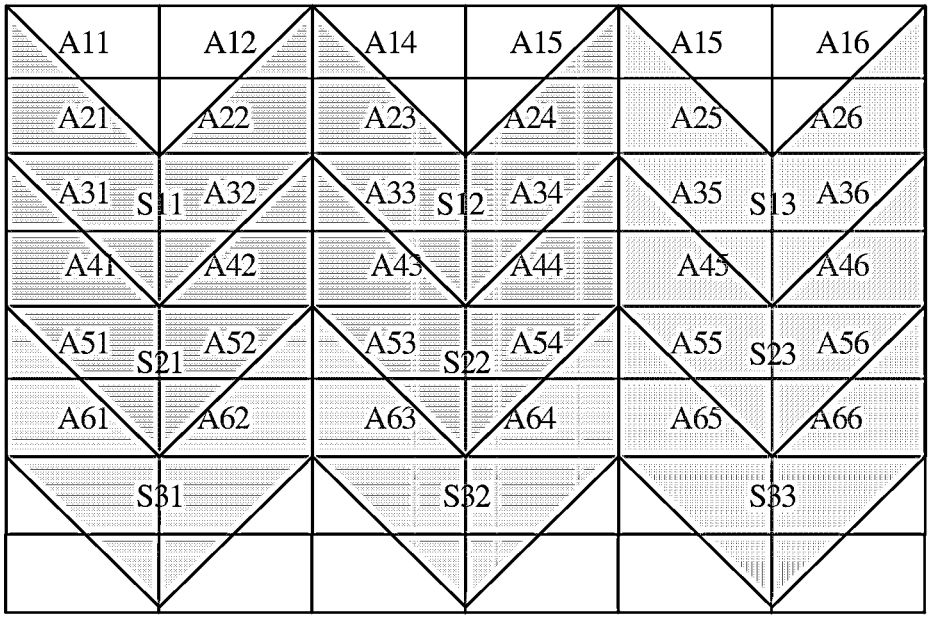
FIG. 8 is a schematic diagram of 3*3 dimming pixels and display pixel groups corresponding to the 3*3 dimming pixels provided by an embodiment of the present disclosure.

For example, in an example of the present disclosure, FIG. 8 shows 3*3 dimming pixels, the 3*3 dimming pixels includes S11 to S33, respectively, and FIG. 8 also shows display pixels A11-A66 corresponding to the 3*3 dimming pixels. According to the above embodiments of the present disclosure, the second gray scale values $y_{sub2}$ of the dimming pixels S11 to S33 can be obtained by the input pixel values corresponding to the display pixels A11-A66, respectively. In FIG. 8, it is assumed that the dimming pixel located in the first row and the first column in the dimming screen is the first dimming pixel S11, and the dimming pixel located in the second row and the first column in the dimming screen is the second dimming pixel S21. The process of calculating the third gray-scale value $y_{sub3}$ of the first dimming pixel S11 will be described below with reference to the accompanying drawings.

First, a data preparation operation is performed on the second gray-scale value $y_{sub2}$ of the first dimming pixel S11 to obtain the intermediate value of the first dimming pixel S11. In this example, assuming M=10, the data preparation operation includes: taking the high ten-bit data of the second gray-scale value of the first dimming pixel S11 as the first data HD, and taking the low ten-bit data of the second gray-scale value of the second dimming pixel S21 as the second data LD. The length of the first data HD and the length of the second data LD are both ten bits.

Then, the weight value Q of the first dimming pixel S11 is obtained by the above fourth calculation formula, and the intermediate value of the first dimming pixel S11 is obtained by the above fifth calculation formula. The data length of the intermediate value of the first dimming pixel S11 is 10 bits.

The dimming gray-scale value $y_{sub3}$ of the first dimming pixel S11 is obtained based on the intermediate value of the first dimming pixel S11. For example, the data length of the dimming gray-scale value $y_{sub3}$ of the first dimming pixel S11 is 10 bits.

For example, the intermediate value of the first dimming pixel S11 is processed to obtain the dimming gray-scale value $y_{sub3}$ of the first dimming pixel S11. For example, the smooth filtering operation or the bright line detection operation is performed on the intermediate value of the first dimming pixel S11 to obtain the dimming gray-scale value $y_{sub3}$ of the first dimming pixel S11. For the specific operation process of the smooth filtering operation or the bright line detection operation, reference can be made to the relevant contents in the above embodiments, and will not be described in detail here.

Through the above method, the dimming gray-scale values $y_{sub3}$ of the plurality of dimming pixels S11-S23 can be calculated, so as to obtain the data of the dimming image of the current frame of the dimming screen, that is, the dimming screen can display the dimming image based on the calculated dimming gray-scale values $y_{sub3}$ of the plurality of dimming pixels.

For example, in an embodiment of the present disclosure, step S350 includes according to an actual corresponding relationship between the dimming pixels and the display pixels, determining a dimming pixel group corresponding to each of the plurality of first display pixels in the plurality of dimming pixels, the dimming pixel group comprising MS dimming pixels, and the MS dimming pixels comprising the first dimming pixel; performing a summation operation on the dimming gray-scale values of the MS dimming pixels to determine a plurality of equivalent gray-scale values corresponding to the plurality of first display pixels; determining a plurality of compensation coefficients corresponding to the plurality of first display pixels according to the plurality of input gray-scale values of the input image and the plurality of equivalent gray-scale values corresponding to the plurality of first display pixels; and determining the plurality of target gray-scale values corresponding to the plurality of first display pixels according to the plurality of input gray-scale values of the input image and the plurality of compensation coefficients corresponding to the plurality of first display pixels.

For example, in an embodiment of the present disclosure, performing the summation operation on the dimming gray-scale values of the MS dimming pixels to determine the plurality of equivalent gray-scale values corresponding to the plurality of first display pixels, comprises: with respect to a W-th first display pixel among the plurality of first display pixels, calculating MS area overlap ratios of the W-th first display pixel and the MS dimming pixels, respectively, W being a positive integer and being less than or equal to the amount of the plurality of first display pixels; performing the summation operation on the dimming gray-scale values of the MS dimming pixels according to the MS area overlap ratios, and determining an equivalent gray-scale value corresponding to the W-th first display pixel, performing the above operations on the plurality of first display pixels, so as to obtain the plurality of equivalent gray-scale values corresponding to the plurality of first display pixels.

For example, in an embodiment of the present disclosure, the MS dimming pixels also include a third dimming pixel, and the equivalent gray-scale value corresponding to the W-th first display pixel is:

$$y_{eq}(W)=C1*y_{sub3}(B1)+C2*y_{sub3}(B2),$$

where W represents the W-th first display pixel, B1 represents the first dimming pixel, B2 represents the third dimming pixel, C1 represents an area overlap ratio between the first dimming pixel and the W-th first display pixel, C2 represents an area overlap ratio between the third dimming pixel and the W-th first display pixel, $y_{sub3}(B1)$ represents the dimming gray-scale value of the first dimming pixel, $y_{sub3}(B2)$ represents a dimming gray-scale value of the third dimming pixel, and $y_{eq}(W)$ represents the equivalent gray-scale value corresponding to the W-th first display pixel.

For example, in some embodiments, the W-th first display pixel may be the first display pixel A31 shown in FIG. 8. Next, the process of determining the equivalent gray-scale value corresponding to the first display pixel A31 in the above embodiment will be described in detail with reference to FIG. 9.

Figure 9:
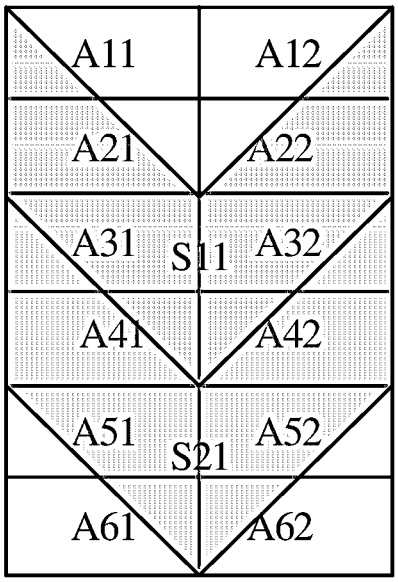
FIG. 9 is a schematic diagram of a first display pixel and a dimming pixel group corresponding to the first display pixel provided by an embodiment of the present disclosure.

For example, in an embodiment of the present disclosure, as shown in FIG. 9, it is assumed that the dimming pixel group corresponding to the first display pixel A31 in the display screen 110 includes two dimming pixels, namely, the first dimming pixel S11 and the third dimming pixel S21, according to the fitting data between the dimming screen 120 and the display screen 110 and the actual corresponding relationship between the dimming pixels and the display pixels. It can be seen from FIG. 9 that the area overlap ratio of the first dimming pixel S11 and the first display pixel A31 is 0.75, while the area overlap ratio of the third dimming pixel S21 and the first display pixel A31 is 0.25, therefore, the equivalent gray-scale value corresponding to the first display pixel A31 is:

$$y_{eq}(A31)=0.75*y_{sub3}(S11)+0.25*y_{sub3}(S21)$$

where $y_{sub3}$(S11) represents the dimming gray-scale value of the first dimming pixel S11, $y_{sub3}$(S21) represents the dimming gray-scale value of the third dimming pixel S21, and $y_{eq}$(A31) represents the equivalent gray-scale value corresponding to the first display pixel A31.

It should be noted that the equivalent gray-scale values corresponding to the plurality of first display pixels can also be calculated in other ways, the embodiments of the present disclosure do not specifically limit this.

For example, in an embodiment of the present disclosure, determining the plurality of compensation coefficients corresponding to the plurality of first display pixels according to the plurality of input gray-scale values of the input image and the plurality of equivalent gray-scale values corresponding to the plurality of first display pixels, comprises: determining a plurality of input gray-scale values, corresponding to the plurality of first display pixels, of the input image, and determining a plurality of input pixel gray-scale values corresponding to the plurality of first display pixels according to a plurality of sub-input gray-scale values of the plurality of input gray-scale values corresponding to the plurality of first display pixels.

According to the input pixel gray-scale values corresponding to the plurality of first display pixels and the plurality of equivalent gray-scale values corresponding to the plurality of first display pixels, the plurality of compensation coefficients corresponding to the plurality of first display pixels are calculated by a sixth formula. The sixth formula is as follows:

$$y_c(W)^{\gamma 2}=y_{in}(W)^{\gamma 0}\cdot 1/y_{eq}(W)^{\gamma 1},$$

where $Y_c$(W) is a compensation coefficient corresponding to the W-th first display pixel among the plurality of first display pixels, $y_{in}$(W) is the input pixel gray-scale value corresponding to the W-th first display pixel, $y_{eq}$(W) is the equivalent gray-scale value corresponding to the W-th first display pixel, W is a positive integer and is less than or equal to the amount of the plurality of first display pixels, and $\gamma 1=1$, $\gamma 2=\gamma 0=2.2$.

It should be noted that $\gamma 0$ represents a gamma value of the input image, $\gamma 1$ represents a gamma value of the dimming image of the dimming screen, and $\gamma 2$ represents a gamma value of the display image of the display screen. The $\gamma 1=1$ and $\gamma 2=\gamma 0=2.2$ provided by the embodiments of the present disclosure are only exemplary, and the specific values of $\gamma 1$, $\gamma 2$, and $\gamma 0$ can be adjusted according to the actual situation. The embodiments of the present disclosure are not particularly limited to this case.

It should be noted that the method to determine the input pixel gray-scale values corresponding to the plurality of first display pixels can refer to the description in the above embodiments, and the repetition is not repeated here.

For example, in an embodiment of the present disclosure, determining the plurality of target gray-scale values corresponding to the plurality of first display pixels according to the plurality of input gray-scale values of the input image and the plurality of compensation coefficients corresponding to the plurality of first display pixels comprises: determining the input gray-scale values, corresponding to the plurality of first display pixels, of the input image; according to the input gray-scale values corresponding to the plurality of first display pixels and the plurality of compensation coefficients corresponding to the plurality of first display pixels, determining the plurality of target gray-scale values corresponding to the plurality of first display pixels.

For example, in an embodiment of the present disclosure, the plurality of first display pixels comprise a W-th first display pixel, the W-th first display pixel comprises a first sub-display pixel, a second sub-display pixel, and a third sub-display pixel, W is a positive integer and is less than or equal to the amount of the plurality of first display pixels. A target gray-scale value corresponding to the W-th first display pixel comprises a first sub-target gray-scale value corresponding to the first sub-display pixel, a second sub-target gray-scale value corresponding to the second sub-display pixel, and a third sub-target gray-scale value corresponding to the third sub-display pixel. The input gray-scale value corresponding to the W-th first display pixel comprises a first sub-input gray-scale value corresponding to the first sub-display pixel, a second sub-input gray-scale value corresponding to the second sub-display pixel, and a third sub-input gray-scale value corresponding to the third sub-display pixel, and the input pixel gray-scale value corresponding to the W-th first display pixel is determined according to the first sub-input gray-scale value, the second sub-input gray-scale value, and the third sub-input gray-scale value.

For example, determining the plurality of target gray-scale values corresponding to the plurality of first display pixels according to the input gray-scale values corresponding to the plurality of first display pixels and the plurality of compensation coefficients corresponding to the plurality of first display pixels comprises: calculating the plurality of target gray-scale values corresponding to the plurality of first display pixels by a seventh group of formulas. For the W-th first display pixel, the seventh group of formulas is as follows:

$$y_{out}(RW)=y_c(W)*(1/(y_{in}(W)))*\text{Input}(RW),$$

$$y_{out}(GW)=y_c(W)*(1/(y_{in}(W)))*\text{Input}(GW),$$

$$y_{out}(BW)=y_c(W)*(1/(y_{in}(W)))*\text{Input}(BW),$$

where $y_{out}$(RW), $y_{out}$(GW), and $y_{out}$(BW) are the first sub-target gray-scale value, the second sub-target gray-scale value, and the third sub-target gray-scale value corresponding to the W-th first display pixel, and Input(RW), Input (GW), and Input(BW) respectively represent the first sub-input gray-scale value, the second sub-input gray-scale value, and the third sub-input gray-scale value corresponding to the W-th first display pixel, $y_{in}$(W) is the input pixel gray-scale value corresponding to the W-th first display pixel, and $y_c$(W) is the compensation coefficient corresponding to the W-th first display pixel.

The above describes the display data processing method 30 in the working mode Mode_1, that is, in the case where the frequency of the dimming screen 120 and the frequency of the display screen 110 are consistent, and the target gray-scale values corresponding to the plurality of display pixels in the display screen and the dimming gray-scale values according to the plurality of dimming pixels can be obtained. According to the target gray-scale values corresponding to the plurality of display pixels, the display screen can display the display image corresponding to the display screen, and the dimming screen can display the dimming image corresponding to the dimming screen according to the dimming gray-scale values of the plurality of dimming pixels. Through the above display data processing method, the data of the input image is processed to obtain the data of the dimming image of the dimming screen and the data of the display image of the display screen, and in the case where the dimming screen displays the dimming image and the display screen displays the display image, due to the modulation of the dimming image to the backlight, the dimming screen and the display screen can cooperate to achieve a finer display effect, a higher contrast, more natural gray-scale transition, achieve the extreme dark-field visual effect, improve the data processing accuracy, and reduce hardware memory.

The display data processing method 20 as shown in FIG. 2 also includes the case where the frequency of the dimming screen 120 and the frequency of the display screen 110 are inconsistent, that is, the working mode Mode_2. It should be noted that "the frequency of the dimming screen 120 and the frequency of the display screen 110 are inconsistent" means that the dimming images displayed on the dimming screen are not synchronized with the display images displayed on the display screen. For example, within a unit time (for example, one second), the dimming screen displays 12 frames of dimming images, while the display screen displays 24 frames of display images, and one frame of dimming image corresponds to two frames of display images. For example, the first frame dimming image corresponds to the first frame display image and the second frame display image, the second frame dimming image corresponds to the third frame display image and the fourth frame display image, and so on.

For example, in an embodiment of the present disclosure, the display data processing method 20 further includes: in response to a case where the frequency of the dimming screen 120 is inconsistent with the frequency of the display screen 110: acquiring a plurality of frame input images; according to a frequency relationship between the dimming screen 120 and the display screen 110, determining MD frame display images, corresponding to an x-th frame dimming image of the dimming screen 120, of the display screen 110. The MD frame display images correspond to MD frame input images among the plurality of frame input images, and the x-th frame dimming image corresponds to an i-th frame input image among the MD frame input images, 1<=i<=MD, x is a positive integer greater than 1, and MD is a positive integer greater than 1. The display data processing method 20 further includes: according to the plurality of input gray-scale values corresponding to the i-th frame input image, determining an x-th feature value corresponding to the x-th frame dimming image; according to the x-th feature value, determining an x-th set value corresponding to the x-th frame dimming image; and in a case where the x-th frame dimming image is displayed on the dimming screen, taking the x-th set value as the dimming gray-scale value of the first dimming pixel.

For example, in an embodiment of the present disclosure, a frame rate of the display screen 110 is twice a frame rate of the dimming screen 120, that is, one frame of dimming image corresponds to two frames of display images.

It should be noted that a feature value corresponding to a frame dimming image can be determined according to the plurality of input gray-scale values corresponding to any one of two display images corresponding to the frame dimming image. For example, in some embodiments, MD=2 and i can be either 1 or 2. For another example, it is also possible to calculate two feature values corresponding to the frame dimming image according to a plurality of input gray-scale values corresponding to the two display images, and then determine the final feature value corresponding to the frame dimming image based on the average value of the two feature values.

For example, in an embodiment of the present disclosure, according to the plurality of input gray-scale values corresponding to the i-th frame input image, determining the x-th feature value corresponding to the x-th frame dimming image, comprises: according to all input pixel gray-scale values corresponding to all input gray-scale values of the i-th frame input image, determining the x-th feature value corresponding to the x-th frame dimming image.

For example, the x-th feature value is:

$$Ld(x)=k1*\max(x)+k2*\text{mean}(x),$$

where 0<k1<1, k2=(1−k1)*N, and 1<N<5, max(x) is a maximum value among the all input pixel gray-scale values corresponding to all input gray-scale values of the i-th frame input image; mean(x) is an average value of the all input pixel gray-scale values corresponding to all input gray-scale values of the i-th frame input image, and Ld(x) represents the x-th feature value.

For example, in an embodiment of the present disclosure, the display data processing method 20 further includes: presetting a first set value corresponding to a first frame dimming image, and taking the first set value as the dimming gray-scale value of the first dimming pixel in the case where the first frame dimming image is displayed on the dimming screen 120.

For example, in an embodiment of the present disclosure, the display data processing method 20 further includes: acquiring a (x+1)-th set value corresponding to an (x+1)-th frame dimming image of the dimming screen.

For example, acquiring the (x+1)-th set value corresponding to the (x+1)-th frame dimming image of the dimming screen, comprises: acquiring the x-th feature value and the x-th set value; according to the x-th feature value and the x-th set value, determining the (x+1)-th set value corresponding to the (x+1)-th frame dimming image.

For example, the (x+1)-th set value is:

$$L(x+1)=k3*L(x)+k4*Ld(x),$$

where L(x+1) is the (x+1)-th set value, L(x) is the x-th set value, Ld(x) is the x-th feature value, and k3=k4=0.5.

Figure 10:
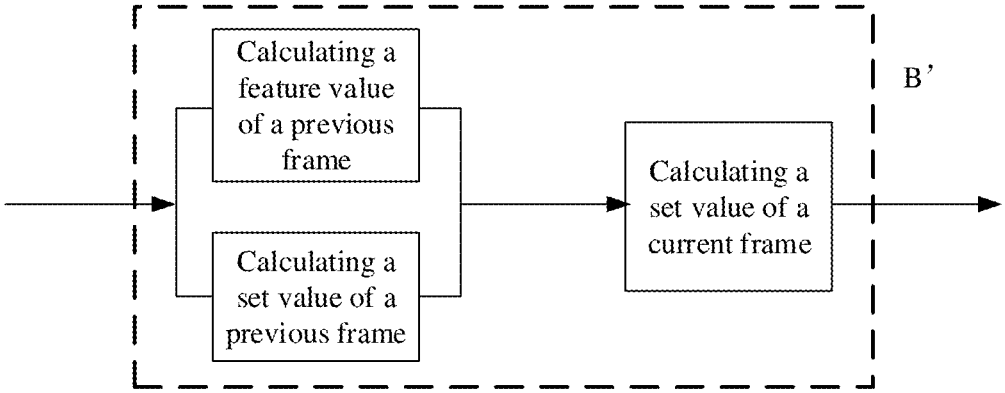
FIG. 10 is a block diagram of a display data processing method provided by an embodiment of the present disclosure.

Therefore, it can be seen that the set value of the dimming image in the current frame (for example, the (x+1)-th frame) is determined based on the set value and the feature value of the dimming image in the previous frame (for example, the x-th frame), and the box B' in FIG. 2 may include the box B' in FIG. 10. Furthermore, the set value L(1) of the first frame dimming image can be preset as L_set. For example, L_set=1023, so as to calculate the set value of the dimming image of each frame. And finally, the set value of the dimming image of each frame is taken as the dimming gray-scale value $y_{sub3}$ of each frame.

Figure 11:
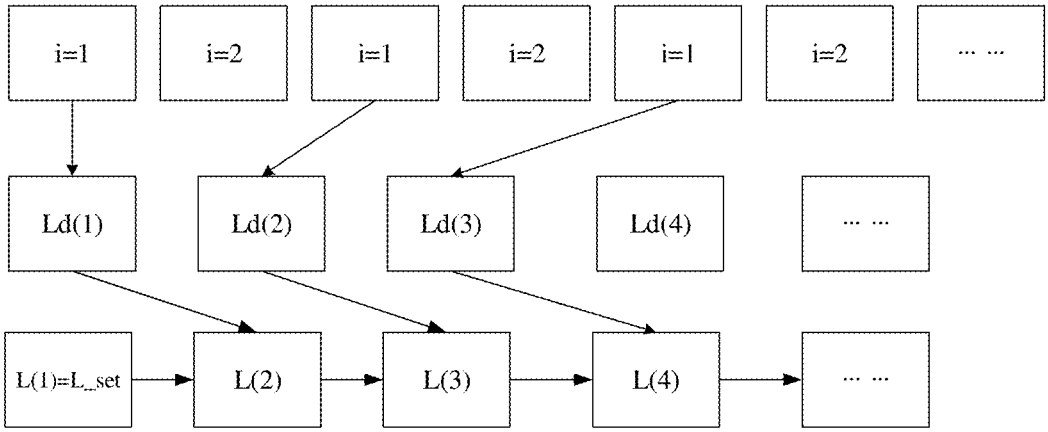
FIG. 11 is a data flow chart showing a display data processing method provided by an embodiment of the present disclosure.

As shown in FIG. 11, it is assumed that one dimming image corresponds to two display images, that is, in the case of MD=2, the feature value corresponding to each frame dimming image is determined according to the plurality of input gray-scale values corresponding to the i-th (for example, i=1) frame input image in the MD frame input images of the MD frame display images corresponding to each frame dimming image, for example, Ld(1) represents the feature value corresponding to the first frame dimming image, Ld(2) represents the feature value corresponding to the second frame dimming image, and so on. For example, L(1) represents the set value corresponding to the first frame dimming image, L(2) represents the set value corresponding to the second frame dimming image, L(3) represents the set value corresponding to the third frame dimming image, and so on. For example, the set value L(1) of the first frame dimming image is preset as L_set, for example, L_set=1023, then L(2) is deduced from Ld(1) and L(1), L(3) is deduced from L(2) and Ld(2), and so on.

As described above, in the case that the frequency of the display screen 110 and the frequency of the dimming screen 120 are inconsistent, using a global dimming method, the dimming screen can display the frame dimming image according to the dimming gray-scale values of the plurality of dimming pixels by obtaining the set value of each frame dimming image as the dimming gray-scale values of the plurality of dimming pixels on the dimming screen when the dimming screen displays, and referring to the foregoing detailed description about step S350, the target gray-scale values corresponding to the plurality of display pixels of the display screen can be obtained according to the dimming gray-scale values of the plurality of dimming pixels and the plurality of input gray-scale values of the input image, so that the display screen can display the display image corresponding to the display screen according to the target gray-scale values corresponding to the plurality of display pixels, which will not be described in detail here.

Figure 12:
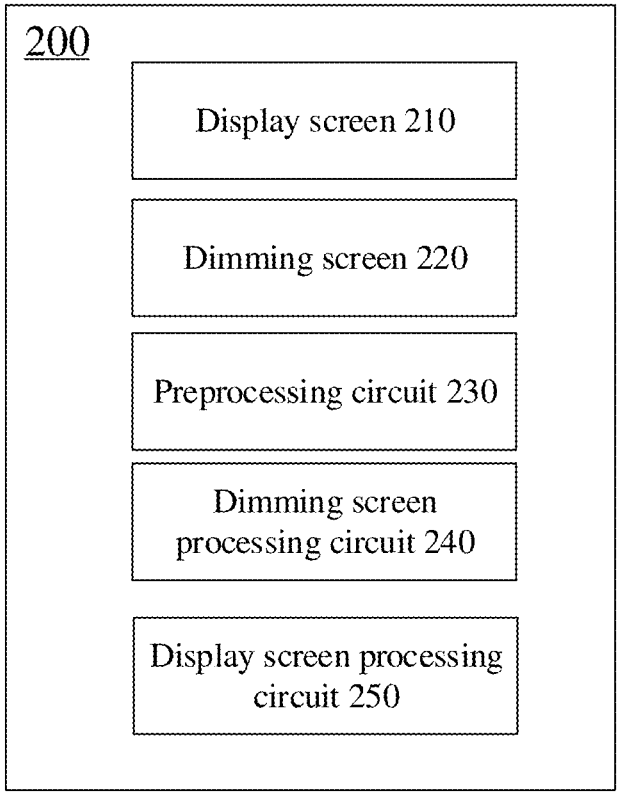
FIG. 12 is a block diagram of a display device provided by an embodiment of the present disclosure.

Embodiments of the present disclosure also provide a display device 200. For example, as shown in FIG. 12, the display device 20 includes a display screen 210, a dimming screen 220, a preprocessing circuit 230, a dimming screen processing circuit 240, and a display screen processing circuit 250.

For example, the dimming screen 220 is disposed on a backlight side of the display screen 210 and is configured to perform backlight modulation on the display screen 210, the dimming screen 220 includes a plurality of dimming pixels, the plurality of dimming pixels comprise a first dimming pixel, the display screen 210 includes a plurality of display pixels, the plurality of display pixels comprise a plurality of first display pixels, and the first dimming pixel is configured to provide backlight modulation for the plurality of first display pixels. The preprocessing circuit 230 is configured to determine a display pixel group corresponding to the first dimming pixel among the plurality of display pixels according to a corresponding relationship between the plurality of display pixels and the plurality of dimming pixels. The display pixel group includes the plurality of first display pixels.

Figure 13:
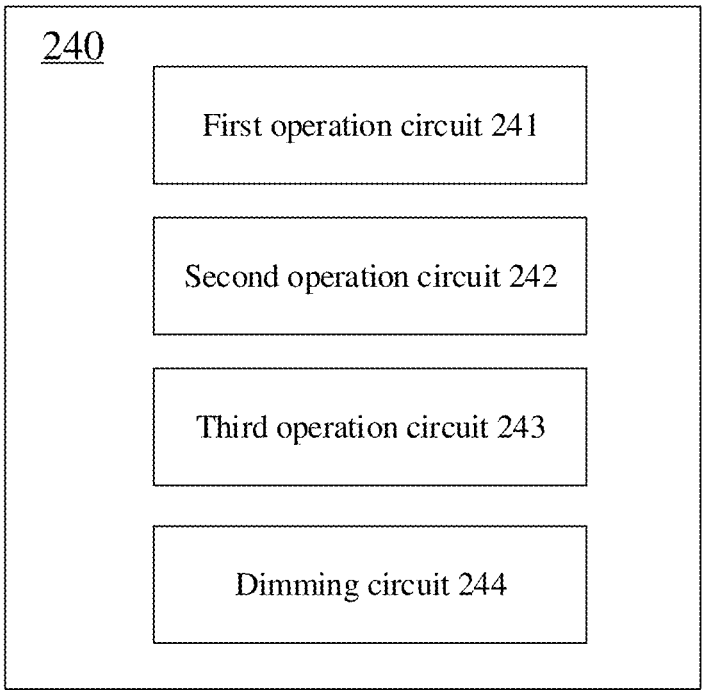
FIG. 13 is a block diagram of a dimming screen processing circuit included in a display device provided by an embodiment of the present disclosure.

Referring to FIG. 13, for example, in an embodiment of the present disclosure, the dimming screen processing circuit 240 includes a first operation circuit 241, a second operation circuit 242, a third operation circuit 243, and a dimming circuit 244. The first operation circuit 241 is configured to determine a first gray-scale value of the first dimming pixel according to a plurality of input gray-scale values, which are in one-to-one correspondence with the plurality of first display pixels, in an input image. The second operation circuit 242 is configured to determine a second gray-scale value of the first dimming pixel according to the first gray-scale value of the first dimming pixel and a noise reduction function. The noise reduction function is a monotonically increasing function in an interval (0, 1), and has an intersection point P(x0, y0) with a function y=x in a case where x is in the interval (0, 1), and in a case where x is in an interval (0, x0), a function value of the noise reduction function is less than a function value y of the function y=x. The third operation circuit 243 is configured to obtain a dimming gray-scale value of the first dimming pixel based on the second gray-scale value of the first dimming pixel. The dimming circuit 244 is configured to drive the dimming screen 120 to display a dimming image and adjust the backlight provided by the backlight module according to the dimming gray-scale value of the first dimming pixel.

Figure 14:
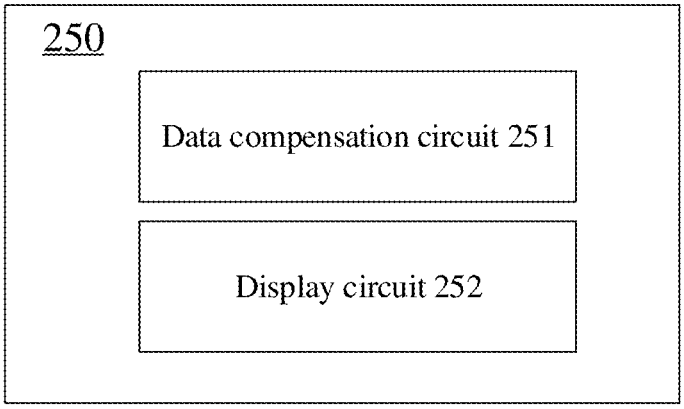
FIG. 14 is a block diagram of a display screen processing circuit included in a display device provided by an embodiment of the present disclosure.

Referring to FIG. 14, for example, in an embodiment of the present disclosure, the display screen processing circuit 250 includes a data compensation circuit 251 and a display circuit 252. For example, the data compensation circuit 251 is configured to determine a plurality of target gray-scale values corresponding to the plurality of first display pixels according to the plurality of input gray-scale values and the dimming gray-scale value of the first dimming pixel. For example, the display circuit 252 is configured to drive the display screen 110 to display to present a display image according to the plurality of target gray-scale values corresponding to the plurality of first display pixels.

For example, the preprocessing circuit 230, the dimming screen processing circuit 240, the display screen processing circuit 250, etc., can be implemented by hardware, software, firmware, and any feasible combination thereof.

Figure 15:
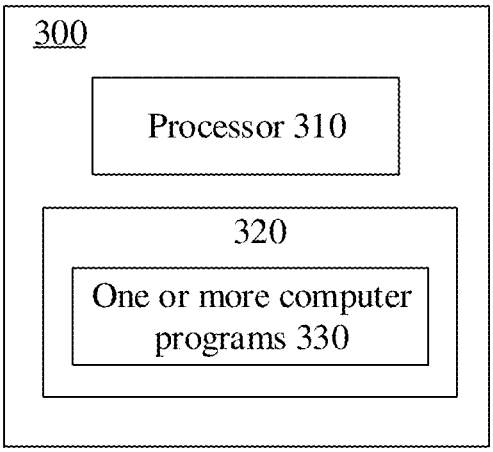
FIG. 15 is a block diagram of an electronic device provided by an embodiment of the present disclosure.

Embodiments of the present disclosure also provide an electronic device. As shown in FIG. 15, the electronic device 300 includes a processor 310 and a memory 320. The memory 320 stores one or more computer programs 330. The one or more computer programs 330 are configured to be executed by the processor 310 to execute the display data processing method according to any one of the above embodiments. It should be noted that the components of the electronic device 300 shown in FIG. 15 are only exemplary and not restrictive, and the electronic device 300 may also have other components according to practical application requirements.

In various embodiments of the present disclosure, the processor 310 may be implemented by an application specific integrated circuit chip, for example, the application specific integrated circuit chip may be disposed on a motherboard, for example, a memory and a power supply circuit may also be disposed on the motherboard; the processor 310 may also be implemented by a circuit or by software, hardware (circuit), firmware, or any combination thereof. In an embodiment of the present disclosure, the processor 310 may include various computing structures, such as a complex instruction set computer (CISC) structure, a reduced instruction set computer (RISC) structure, or a structure that implements a variety of instruction set combinations. In some embodiments, the processor may also be a central processing unit (CPU), a microprocessor, a tensor processor (TPU), a digital processor (DSP), and other devices with data processing capability and/or program execution capability. A central processing unit (CPU) can be X86 or ARM architecture, etc.

In an embodiment of the present disclosure, the memory 320 may be disposed on the above motherboard, for example, and the memory may store instructions and/or data executed by the processor. For example, the memory may include one or more computer program products, the computer program products may include various forms of computer readable memory, such as volatile memory and/or non-volatile memory. The volatile memory may include random access memory (RAM) and/or cache, for example. The non-volatile memory may include, for example, a read-only memory (ROM), a hard disk, a flash memory, and the like. One or more computer program instructions may be stored on the computer readable memory, and the processor 310 may execute the program instructions to implement the desired functions (implemented by the processor) in the embodiments of the present disclosure.

For example, components, such as the processor 310 and the memory 320, can communicate through a network. The network may include a wireless network, a wired network, and/or any combination of the wireless network and the wired network. The network can include a local area network, the Internet, a telecommunication network, Internet of Things based on the Internet and/or the telecommunication network, and/or any combination of the above networks. The wired network can, for example, communicate by twisted pair, coaxial cable, or optical fiber transmission, and wireless networks can, for example, communicate by 3G/4G/5G mobile communication network, Bluetooth, Zigbee, WiFi, or the like. The present disclosure does not limit the type and function of the network here.

The electronic device can be a personal computer, a mobile terminal, etc., and the mobile terminal can be a hardware device with various operating systems such as a mobile phone and a tablet computer.

For a detailed description of the process of executing the display data processing method by the electronic device, reference may be made to the relevant description in the embodiments of the display data processing method, and the repetition parts will not be repeated here.

Figure 16:
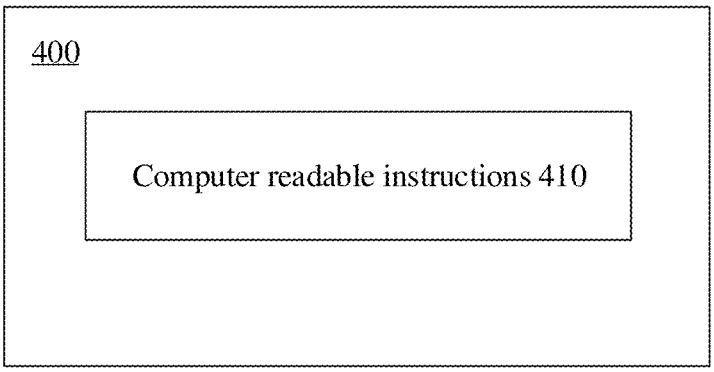
FIG. 16 is a block diagram of a storage medium provided by an embodiment of the present disclosure.

Embodiments of the present disclosure also provide a storage medium. As shown in FIG. 16, the storage medium 400 may store non-transitory computer readable instructions 410 non-temporarily. When the non-transitory computer readable instructions 410 are executed by a computer, the display data processing method described in any of the above embodiments can be executed.

For example, the storage medium 400 can be any combination of one or more computer readable storage media, for example, one computer readable storage medium contains computer readable program codes that respond to the frequency of the dimming screen being consistent with the frequency of the display screen, the other computer readable storage medium contains computer readable program codes for determining a first gray-scale value of the first dimming pixel according to a plurality of input gray-scale values, which are in one-to-one correspondence with the plurality of first display pixels, in an input image, yet another computer readable storage medium contains computer readable program codes for determining a second gray-scale value of the first dimming pixel according to the first gray-scale value of the first dimming pixel and a noise reduction function, the noise reduction function is a monotonically increasing function in an interval (0, 1), and has an intersection point P(x0, y0) with a function y=x in a case where x is in the interval (0, 1), and in a case where x is in an interval (0, x0), a function value of the noise reduction function is less than a function value y of the function y=x, another computer readable storage medium contains computer readable program codes for obtaining a dimming gray-scale value of the first dimming pixel based on the second gray-scale value of the first dimming pixel, and another computer readable storage medium contains computer readable program codes for determining a plurality of target gray-scale values corresponding to the plurality of first display pixels according to the plurality of input gray-scale values and the dimming gray-scale value of the first dimming pixel. Of course, the above program codes can also be stored in the same computer readable medium, and the embodiments of the present disclosure do not limit this. For example, when the program codes are read by a computer, the computer can execute the program code stored in the computer storage medium to execute the display data processing method provided by any embodiment of the present disclosure.

For example, the storage medium can include a memory card of a smart phone, a storage component of a tablet computer, a hard disk of a personal computer, a random access memory (RAM), a read-only memory (ROM), an erasable programmable read-only memory (EPROM), a portable compact disk read-only memory (CD-ROM), a flash memory, or any combination of the above storage media, or can also be other suitable storage media. For example, the readable storage medium can also be the memory 320 in FIG. 15, and the related description can refer to the aforementioned contents, and is not repeated here.

For the present disclosure, the following statements should be noted:

(1) the accompanying drawings of the embodiment(s) of the present disclosure involve only the structure(s) in connection with the embodiment(s) of the present disclosure, and other structure(s) can refer to common design(s); and (2) in case of no conflict, the embodiments of the present disclosure and the features in the embodiment(s) can be combined with each other to obtain new embodiment(s).

What have been described above are only exemplary implementations of the present disclosure, are not intended to limit the protection scope of the present disclosure, and the protection scope of the present disclosure should be determined by the appended claims.

What is claimed is:

1. A display data processing method of a display device, wherein the display device comprises a dimming screen and a display screen, the dimming screen is on a backlight side of the display screen and is configured to perform backlight modulation on the display screen, the dimming screen comprises a plurality of dimming pixels, the plurality of dimming pixels comprise a first dimming pixel, the display screen comprises a plurality of display pixels, the plurality of display pixels comprise a plurality of first display pixels, and the first dimming pixel is configured to provide backlight modulation for the plurality of first display pixels; and the display data processing method comprises:

in response to a frequency of the dimming screen being consistent with a frequency of the display screen:

determining a first gray-scale value of the first dimming pixel according to a plurality of input gray-scale values, which are in one-to-one correspondence with the plurality of first display pixels, in an input image;

determining a second gray-scale value of the first dimming pixel according to the first gray-scale value of the first dimming pixel and a noise reduction function, wherein the noise reduction function is a monotonically increasing function in an interval (0, 1), and has an intersection point P(x0, y0) with a function y=x where x is in the interval (0, 1), and where x is in an interval (0, x0), a function value of the noise reduction function is less than a function value y of the function y=x;

obtaining a dimming gray-scale value of the first dimming pixel based on the second gray-scale value of the first dimming pixel; and determining a plurality of target gray-scale values corresponding to the plurality of first display pixels according to the plurality of input gray-scale values and the dimming gray-scale value of the first dimming pixel.

2. The display data processing method according to claim 1, wherein the noise reduction function comprises:

$$y_{sub2}=1/(1+e^{\wedge}(A-y_{sub1}*B))$$

where A and B are noise reduction parameters and constants, $y_{sub1}$ represents the first gray-scale value of the first dimming pixel, and $y_{sub2}$ is the function value of the noise reduction function and represents the second gray-scale value of the first dimming pixel.

3. The display data processing method according to claim 2, wherein the plurality of dimming pixels are arranged in an array of Q rows and P columns, and the first dimming pixel is arranged in an a-th row and b-th column in the array formed by the plurality of dimming pixels, wherein Q, P, a, and b are positive integers, and $1 \le a \le Q$, $1 \le b \le P$;

determining the first gray-scale value of the first dimming pixel according to the plurality of input gray-scale values, which are in one-to-one correspondence with the plurality of first display pixels, in the input image, comprises:

determining a display pixel group corresponding to the first dimming pixel among the plurality of display pixels, wherein the display pixel group comprises the plurality of first display pixels, each of the plurality of first display pixels comprises a plurality of first sub-display pixels, and each of the plurality of input gray-scale values comprises a plurality of sub-input gray-scale values, and the plurality of sub-input gray-scale values are in one-to-one correspondence with the plurality of first sub-display pixels;

determining an input pixel gray-scale value corresponding to each of the plurality of first display pixels according to the plurality of sub-input gray-scale values of an input gray-scale value corresponding to each of the plurality of first display pixels, to obtain a plurality of input pixel gray-scale values corresponding to the plurality of first display pixels; and determining the first gray-scale value of the first dimming pixel according to the plurality of input pixel gray-scale values corresponding to the plurality of first display pixels.

4. The display data processing method according to claim 3, wherein the plurality of first display pixels are arranged in an array of nt rows and mt columns, where nt is a positive integer and mt is a positive integer;

the determining the first gray-scale value of the first dimming pixel according to the plurality of input pixel gray-scale values corresponding to the plurality of first display pixels, comprises:

according to the plurality of input pixel gray-scale values corresponding to the plurality of first display pixels, calculating nt row sampling values of the nt rows corresponding to the plurality of first display pixels by a first group of calculation formulas, wherein for a row sampling value of an n-th row in the nt rows, the first group of calculation formulas comprises:

$$S1(n)=(NA*\max(n)>(2^M-1))?(2^M-1):NA*\max(n);$$

$$S2(n)=(NE*\text{mean}(n)>(2M-1))?(2M-1):NE*\text{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and VL(n) is the row sampling value of the n-th row;

determining the first gray-scale value of the first dimming pixel as the maximum value of the nt row sampling values corresponding to the plurality of first display pixels.

5. The display data processing method according to claim 3, wherein the plurality of first display pixels are arranged in an array of nt rows and mt columns, nt is a positive integer and mt is a positive integer; and the determining the first gray-scale value of the first dimming pixel according to the plurality of input pixel gray-scale values corresponding to the plurality of first display pixels, comprises:

according to the plurality of input pixel gray-scale values corresponding to the plurality of first display pixels, calculating nt row sampling values of the nt rows corresponding to the plurality of first display pixels by a first group of calculation formulas, wherein for a row sampling value of an n-th row in the nt rows, the first group of calculation formulas comprises:

$$S1(n)=(NA*\max(n)>(2^M-1))?(2^M-1):NA*\max(n);$$

$$S2(n)=(NE*\text{mean}(n)>(2^M-1))?(2^M-1):NE*\text{mean}(n);$$

$$VL(n)=KL(n)*(KA*S1(n)+(1-KA)*S2(n));$$

where max(n) is a maximum value of input pixel gray-scale values corresponding to first display pixels in the n-th row, mean(n) is an average value of the input pixel gray-scale values corresponding to the first display pixels in the n-th row, n is an integer and $1 \le n \le nt$, NA=NE=KA=1, KL(n)=0.5 or 0.25, M is a positive integer, S1(n) and S2(n) are results of overflow judgment on NA*max(n) and NE*mean(n), respectively, and the row sampling value of the n-th row takes high M-bit of VL(n);

calculating nt row correction values of the nt rows by a second calculation formula, wherein for a row correction value of the n-th row, the second calculation formula comprises:

$$VLX(n)=KX(n)*(KA*S1(n)+(1-KA)*S2(n)),$$

where KX(n)=0.5 or 0.25, and the row correction value of the n-th row takes high M-bit data of VLX(n);

according to the nt row sampling values and the nt row correction values, calculating nt row final values of the nt rows by a third calculation formula, wherein for a row final value of the n-th row, the third calculation formula comprises:

$$VLF(n)=(VL(n)\ll M)+VLX(n);$$

where VLF(n) represents the row final value of the n-th row;

taking maximum high M-bit data among nt high M-bit data in the nt row final values and maximum low M-bit data among nt low M-bit data in the nt row final values, to obtain the first gray-scale value of the first dimming pixel, wherein a length of the first gray-scale value of the first dimming pixel is 2*M bits.

6. The display data processing method according to claim 5, wherein the determining the second gray-scale value of the first dimming pixel according to the first gray-scale value and the noise reduction function, comprises:

taking high M-bit data of the first gray-scale value of the first dimming pixel, and calculating high M-bit data of the second gray-scale value of the first dimming pixel by the noise reduction function; and taking low M-bit data of the first gray-scale value of the first dimming pixel, and calculating low M-bit data of the second gray-scale value of the first dimming pixel by the noise reduction function, wherein a length of the second gray-scale value of the first dimming pixel is 2*M bits.

7. The display data processing method according to claim 6, wherein the plurality of dimming pixels further comprise a second dimming pixel, and the second dimming pixel is in a (a+1)-th row and b-th column in the array formed by the plurality of dimming pixels, and obtaining the dimming gray-scale value of the first dimming pixel based on the second gray-scale value of the first dimming pixel, comprises:

performing a data preparation operation on the second gray-scale value of the first dimming pixel, to obtain an intermediate value of the first dimming pixel, wherein the data preparation operation comprises:

taking the high M-bit data of the second gray-scale value of the first dimming pixel as first data, and taking the low M-bit data of the second gray-scale value of the second dimming pixel as second data; wherein a length of the first data and a length of the second data are both M bits;

obtaining a weight value of the first dimming pixel by a fourth calculation formula, wherein the fourth calculation formula comprises:

$$Q=KS*LD+(1-KS)*HD;$$

where HD is the first data, LD is the second data, KS=0.5, and Q is the weight value of the first dimming pixel;

obtaining the intermediate value of the first dimming pixel by a fifth calculation formula, wherein the fifth calculation formula comprises:

$$T=KQ*Q+(1-KQ)*Z;$$

where Z is a maximum value between the first data and the second data, and KQ=0.5, and the intermediate value of the first dimming pixel is high M-bit data of T; and obtaining the dimming gray-scale value of the first dimming pixel based on the intermediate value of the first dimming pixel.

8. The display data processing method according to claim 3, wherein the determining the display pixel group corresponding to the first dimming pixel among the plurality of display pixels, comprises:

acquiring alignment fitting data used for recording an alignment situation between the dimming screen and the display screen, according to the alignment fitting data, obtaining an actual corresponding relationship between the plurality of display pixels and the plurality of dimming pixels from a theoretical corresponding relationship between the plurality of display pixels and the plurality of dimming pixels, and determining the display pixel group corresponding to the first dimming pixel among the plurality of display pixels according to the actual corresponding relationship.

9. The display data processing method according to claim 1, wherein the obtaining the dimming gray-scale value of the first dimming pixel based on the second gray-scale value of the first dimming pixel, comprises:

processing the second gray-scale value of the first dimming pixel, to obtain the dimming gray-scale value of the first dimming pixel.

10. The display data processing method according to claim 1, further comprising:

in response to the frequency of the dimming screen being inconsistent with the frequency of the display screen:

acquiring a plurality of frame input images;

according to a frequency relationship between the dimming screen and the display screen, determining MD frame display images, corresponding to an x-th frame dimming image of the dimming screen, of the display screen, wherein the MD frame display images correspond to MD frame input images among the plurality of frame input images, and the x-th frame dimming image corresponds to an i-th frame input image among the MD frame input images, 1<=i<=MD, x is a positive integer greater than 1, and MD is a positive integer greater than 1;

according to a plurality of input gray-scale values corresponding to the i-th frame input image, determining an x-th feature value corresponding to the x-th frame dimming image;

according to the x-th feature value, determining an x-th set value corresponding to the x-th frame dimming image; and when the x-th frame dimming image is displayed on the dimming screen, taking the x-th set value as the dimming gray-scale value of the first dimming pixel.

11. The display data processing method according to claim 10, wherein each input gray-scale value of the plurality of input gray-scale values corresponding to the i-th frame input image comprises a plurality of sub-input gray-scale values, and an input pixel gray-scale value corresponding to each input gray-scale value is determined according to the plurality of sub-input gray-scale values; and according to the plurality of input gray-scale values corresponding to the i-th frame input image, determining the x-th feature value corresponding to the x-th frame dimming image, comprises:

according to all input pixel gray-scale values corresponding to all input gray-scale values of the i-th frame input image, determining the x-th feature value corresponding to the x-th frame dimming image, wherein the x-th feature value is:

$$Ld(x)=k1*\max(x)+k2*\text{mean}(x),$$

where 0<k1<1, k2=(1−k1)*N, and 1<N<5, max(x) is a maximum value among the all input pixel gray-scale values corresponding to the all input gray-scale values of the i-th frame input image, mean(x) is an average value of the all input pixel gray-scale values corresponding to the all input gray-scale values of the i-th frame input image, and Ld(x) represents the x-th feature value.

12. The display data processing method according to claim 10, further comprising:

acquiring a (x+1)-th set value corresponding to an (x+1)-th frame dimming image of the dimming screen, wherein the acquiring the (x+1)-th set value corresponding to the (x+1)-th frame dimming image of the dimming screen, comprises:

acquiring the x-th feature value and the x-th set value;

according to the x-th feature value and the x-th set value, determining the (x+1)-th set value corresponding to the (x+1)-th frame dimming image, wherein the (x+1)-th set value is:

$$L(x+1)=k3*L(x)+k4*Ld(x),$$

where L(x+1) is the (x+1)-th set value, L(x) is the x-th set value, Ld(x) is the x-th feature value, and k3=k4=0.5.

13. The display data processing method according to claim 1, wherein the determining the plurality of target gray-scale values corresponding to the plurality of first display pixels according to the plurality of input gray-scale values and the dimming gray-scale value of the first dimming pixel, comprises:

according to an actual corresponding relationship between the plurality of dimming pixels and the plurality of display pixels, determining a dimming pixel group corresponding to each of the plurality of first display pixels in the plurality of dimming pixels, wherein the dimming pixel group comprises MS dimming pixels, and the MS dimming pixels comprises the first dimming pixels;

performing a summation operation on dimming gray-scale values of the MS dimming pixels, to determine a plurality of equivalent gray-scale values corresponding to the plurality of first display pixels;

determining a plurality of compensation coefficients corresponding to the plurality of first display pixels according to the plurality of input gray-scale values of the input image and the plurality of equivalent gray-scale values corresponding to the plurality of first display pixels; and determining the plurality of target gray-scale values corresponding to the plurality of first display pixels according to the plurality of input gray-scale values of the input image and the plurality of compensation coefficients corresponding to the plurality of first display pixels.

14. The display data processing method according to claim 13, wherein the performing the summation operation on the dimming gray-scale values of the MS dimming pixels, to determine the plurality of equivalent gray-scale values corresponding to the plurality of first display pixels, comprises:

with respect to a W-th first display pixel among the plurality of first display pixels, calculating MS area overlap ratios of the W-th first display pixel and the MS dimming pixels, respectively, wherein W is a positive integer and is less than or equal to an amount of the plurality of first display pixels, performing the summation operation on the dimming gray-scale values of the MS dimming pixels according to the MS area overlap ratios, and determining an equivalent gray-scale value corresponding to the W-th first display pixel, so as to obtain the plurality of equivalent gray-scale values corresponding to the plurality of first display pixels.

15. The display data processing method according to claim 13, wherein each input gray-scale value of the plurality of input gray-scale values comprises a plurality of sub-input gray-scale values;

determining the plurality of compensation coefficients corresponding to the plurality of first display pixels according to the plurality of input gray-scale values of the input image and the plurality of equivalent gray-scale values corresponding to the plurality of first display pixels, comprises:

determining input gray-scale values, corresponding to the plurality of first display pixels, of the input image, and determining input pixel gray-scale values corresponding to the plurality of first display pixels according to a plurality of sub-input gray-scale values of the input gray-scale values corresponding to the plurality of first display pixels;

calculating the plurality of compensation coefficients corresponding to the plurality of first display pixels by a sixth formula according to the input pixel gray-scale values corresponding to the plurality of first display pixels and the plurality of equivalent gray-scale values corresponding to the first display pixels, wherein the sixth formula comprises:

$$y_c(W)^{\gamma 2}=y_{in}(W)^{\gamma 0}\cdot 1/y_{eq}(W)^{\gamma 1},$$

where $y_c(W)$ is a compensation coefficient corresponding to a W-th first display pixel among the plurality of first display pixels, $y_{in}(W)$ is an input pixel gray-scale value corresponding to the W-th first display pixel, $y_{eq}(W)$ is an equivalent gray-scale value corresponding to the W-th first display pixel, W is a positive integer and is less than or equal to an amount of the plurality of first display pixels, and γ1=1, γ2=γ0=2.2.

16. The display data processing method according to claim 13, wherein determining the plurality of target gray-scale values corresponding to the plurality of first display pixels according to the plurality of input gray-scale values of the input image and the plurality of compensation coefficients corresponding to the plurality of first display pixels comprises:

determining input gray-scale values, corresponding to the plurality of first display pixels, of the input image;

determining the plurality of target gray-scale values corresponding to the plurality of first display pixels according to the input gray-scale values corresponding to the plurality of first display pixels and the plurality of compensation coefficients corresponding to the plurality of first display pixels.

17. The display data processing method according to claim 16, wherein the plurality of first display pixels comprise a W-th first display pixel, the W-th first display pixel comprises a first sub-display pixel, a second sub-display pixel, and a third sub-display pixel, W is a positive integer and is less than or equal to an amount of the plurality of first display pixels, a target gray-scale value corresponding to the W-th first display pixel comprises a first sub-target gray-scale value corresponding to the first sub-display pixel, a second sub-target gray-scale value corresponding to the second sub-display pixel, and a third sub-target gray-scale value corresponding to the third sub-display pixel, an input gray-scale value corresponding to the W-th first display pixel comprises a first sub-input gray-scale value corresponding to the first sub-display pixel, a second sub-input gray-scale value corresponding to the second sub-display pixel, and a third sub-input gray-scale value corresponding to the third sub-display pixel, and an input pixel gray-scale value corresponding to the W-th first display pixel is determined according to the first sub-input gray-scale value, the second sub-input gray-scale value, and the third sub-input gray-scale value, wherein determining the plurality of target gray-scale values corresponding to the plurality of first display pixels according to the input gray-scale values corresponding to the plurality of first display pixels and the plurality of compensation coefficients corresponding to the plurality of first display pixels, comprises:

calculating the plurality of target gray-scale values corresponding to the plurality of first display pixels by a seventh group of formulas, wherein for the W-th first display pixel, the seventh group of formulas is:

$$y_{out}(RW)=y_c(W)*(1/(y_{in}(W)))*\text{Input}(RW)$$

$$y_{out}(GW)=y_c(W)*(1/(y_{in}(W)))*\text{Input}(GW)$$

$$y_{out}(BW)=y_c(W)*(1/(y_{in}(W)))*\text{Input}(BW)$$

where $y_{out}$(RW), $y_{out}$(GW), and $y_{out}$(BW) are the first sub-target gray-scale value, the second sub-target gray-scale value, and the third sub-target gray-scale value corresponding to the W-th first display pixel, respectively, and Input(RW), Input(GW), and Input(BW) respectively represent the first sub-input gray-scale value, the second sub-input gray-scale value, and the third sub-input gray-scale value corresponding to the W-th first display pixel, $y_{in}$(W) is the input pixel gray-scale value corresponding to the W-th first display pixel, and $y_c$(W) is a compensation coefficient corresponding to the W-th first display pixel.

18. A storage medium, storing computer readable instructions in a non-transitory manner, wherein the computer readable instructions are executed by a computer, the display data processing method according to claim 1 is executed.

19. A display device, comprising:

a dimming screen and a display screen, wherein the dimming screen is on a backlight side of the display screen and is configured to perform backlight modulation on the display screen, the dimming screen comprises a plurality of dimming pixels, the plurality of dimming pixels comprise a first dimming pixel, the display screen comprises a plurality of display pixels, the plurality of display pixels comprise a plurality of first display pixels, and the first dimming pixel is configured to provide backlight modulation for the plurality of first display pixels, a preprocessing circuit, configured to determine a display pixel group corresponding to the first dimming pixel among the plurality of display pixels according to a corresponding relationship between the plurality of display pixels and the plurality of dimming pixels;

a dimming screen processing circuit comprising:

a first operation circuit, configured to determine a first gray-scale value of the first dimming pixel according to a plurality of input gray-scale values, which are in one-to-one correspondence with the plurality of first display pixels, in an input image;

a second operation circuit, configured to determine a second gray-scale value of the first dimming pixel according to the first gray-scale value of the first dimming pixel and a noise reduction function, wherein the noise reduction function is a monotonically increasing function in an interval (0, 1), and has an intersection point P(x0, y0) with a function y=x where x is in the interval (0, 1), and where x is in an interval (0, x0), a function value of the noise reduction function is less than a function value y of the function y=x, a third operation circuit, configured to obtain a dimming gray-scale value of the first dimming pixel based on the second gray-scale value of the first dimming pixel; and a dimming circuit, configured to drive the dimming screen to display according to the dimming gray-scale value of the first dimming pixel; and a display screen processing circuit, comprising:

a data compensation circuit, configured to determine a plurality of target gray-scale values corresponding to the plurality of first display pixels according to the plurality of input gray-scale values and the dimming gray-scale value of the first dimming pixel; and a display circuit, configured to drive the display screen to display according to the plurality of target gray-scale values corresponding to the plurality of first display pixels.

20. An electronic device, comprising:

a processor, a memory, storing one or more computer programs, wherein the one or more computer programs are configured to be executed by the processor to execute instructions of a display data processing method of a display device, the display device comprises a dimming screen and a display screen, the dimming screen is on a backlight side of the display screen and is configured to perform backlight modulation on the display screen, the dimming screen comprises a plurality of dimming pixels, the plurality of dimming pixels comprise a first dimming pixel, the display screen comprises a plurality of display pixels, the plurality of display pixels comprise a plurality of first display pixels, and the first dimming pixel is configured to provide backlight modulation for the plurality of first display pixels; and the display data processing method comprises:

in response to a frequency of the dimming screen being consistent with a frequency of the display screen:

determining a first gray-scale value of the first dimming pixel according to a plurality of input gray-scale values, which are in one-to-one correspondence with the plurality of first display pixels, in an input image;

determining a second gray-scale value of the first dimming pixel according to the first gray-scale value of the first dimming pixel and a noise reduction function, wherein the noise reduction function is a monotonically increasing function in an interval (0, 1), and has an intersection point P(x0, y0) with a function y=x where x is in the interval (0, 1), and where x is in an interval (0, x0), a function value of the noise reduction function is less than a function value y of the function y=x;

obtaining a dimming gray-scale value of the first dimming pixel based on the second gray-scale value of the first dimming pixel; and determining a plurality of target gray-scale values corresponding to the plurality of first display pixels according to the plurality of input gray-scale values and the dimming gray-scale value of the first dimming pixel.

* * * * *